US009351540B2

(12) United States Patent
Fisher et al.

(10) Patent No.: US 9,351,540 B2
(45) Date of Patent: May 31, 2016

(54) LAST WITH RETRACTABLE PINS

(71) Applicant: Nike, Inc., Beaverton, OR (US)

(72) Inventors: Sam Fisher, Portland, OR (US); Jared M. Kilmer, Vancouver, WA (US); Thomas Berend, Beaverton, OR (US); Tony H. Le, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 608 days.

(21) Appl. No.: 13/767,011

(22) Filed: Feb. 14, 2013

(65) Prior Publication Data

US 2014/0223671 A1 Aug. 14, 2014

(51) Int. Cl.
*A43D 3/02* (2006.01)
*A43D 3/04* (2006.01)

(52) U.S. Cl.
CPC *A43D 3/02* (2013.01); *A43D 3/022* (2013.01); *A43D 3/04* (2013.01)

(58) Field of Classification Search
CPC ..... A43D 3/02; A43D 3/00; A43D 3/022; A43D 3/028; A43D 3/1408; A43D 5/02; A43D 9/00
USPC ..... 12/133 R, 133 A, 133 B, 140, 141, 129.4, 12/128 R
See application file for complete search history.

(56) References Cited

U.S. PATENT DOCUMENTS 10,679 A * 3/1854 Daugherty ..... A43D 3/02 12/128 F
297,633 A * 4/1884 Reynolds ..... A43D 3/02 12/133 M
715,472 A * 12/1902 French ..... A43D 3/022 12/113
882,919 A * 3/1908 Washburn ..... A43C 11/18 12/113
1,731,024 A 10/1929 Richardson
1,825,276 A * 9/1931 L Hollier ..... A43B 3/20 12/133 R
2,247,818 A * 7/1941 Nast ..... B29D 35/0027 12/133 M
3,141,183 A 7/1964 Ralphs
3,160,899 A 12/1964 Bille et al.
3,228,049 A 1/1966 Sbicca
3,362,091 A 1/1968 Drago
3,512,197 A 5/1970 Harold, Sr
3,803,655 A 4/1974 White et al.
3,855,657 A 12/1974 Mazzotta (Continued)

FOREIGN PATENT DOCUMENTS

CH 285223 A 8/1952
CH 616094 A5 3/1980

(Continued)

OTHER PUBLICATIONS

International Search Report and Written Opinion mailed Sep. 16, 2014 for PCT Application No. PCT/US2014/015921.

(Continued)

*Primary Examiner* — Ted Kavanaugh
(74) *Attorney, Agent, or Firm* — Plumsea Law Group, LLC

(57) ABSTRACT

A last assembly includes a plurality of retractable pins and a plurality of vacuum holes, both acting to hold footwear segments to the last assembly to facilitate manufacturing of, or modification to, an article of footwear. A method of making or modifying an article of footwear includes placing footwear segments on the last assembly by associating an extension portion of at least one footwear segment with the retractable pins, modifying the footwear segments and then removing the extension portion.

20 Claims, 19 Drawing Sheets

(56) References Cited

U.S. PATENT DOCUMENTS

| | | | |
|---|---|---|---|
| 3,938,211 | A | 2/1976 | Armstrong |
| 4,266,312 | A | 5/1981 | Hall |
| 4,290,838 | A | 9/1981 | Reavill et al. |
| 4,601,078 | A | 7/1986 | Bertolaja |
| 4,660,242 | A | 4/1987 | Vornberger et al. |
| 4,964,229 | A | 10/1990 | Laberge |
| 5,108,532 | A | 4/1992 | Thein et al. |
| 5,129,813 | A | 7/1992 | Shepherd |
| 5,275,775 | A | 1/1994 | Riecken |
| 5,296,182 | A | 3/1994 | Thary |
| 5,885,500 | A | 3/1999 | Tawney et al. |
| 5,940,991 | A | 8/1999 | Cabalquinto |
| 6,295,679 | B1 | 10/2001 | Chenevert |
| 6,299,817 | B1 | 10/2001 | Parkinson |
| 6,622,332 | B2 | 9/2003 | Furuhashi |
| 6,670,029 | B2 | 12/2003 | Norton et al. |
| 7,247,264 | B2 | 7/2007 | Buchler et al. |
| 8,162,022 | B2 | 4/2012 | Hull et al. |
| 2008/0028544 | A1 | 2/2008 | Park |
| 2008/0053609 | A1 | 3/2008 | Renz |
| 2008/0127426 | A1 | 6/2008 | Morlacchi et al. |
| 2008/0141469 | A1 | 6/2008 | Park |
| 2008/0250668 | A1 | 10/2008 | Marvin et al. |
| 2010/0051195 | A1 | 3/2010 | Damm |
| 2010/0115792 | A1 | 5/2010 | Muller |
| 2010/0139853 | A1 | 6/2010 | Park |
| 2010/0275393 | A1 | 11/2010 | Jou et al. |
| 2011/0088282 | A1 | 4/2011 | Dojan et al. |
| 2012/0084999 | A1 | 4/2012 | Davis et al. |
| 2012/0102782 | A1 | 5/2012 | Swigart et al. |
| 2014/0237738 | A1 | 8/2014 | Johnson et al. |
| 2014/0237853 | A1 | 8/2014 | Fisher et al. |
| 2014/0239556 | A1 | 8/2014 | Fisher et al. |

FOREIGN PATENT DOCUMENTS

| | | | | |
|---|---|---|---|---|
| DE | 19844539 | A1 * | 3/2000 | ..... A43D 3/022 |
| EP | 42136 | | 12/1981 | |
| EP | 0222964 | | 5/1987 | |
| EP | 0264896 | A1 | 4/1988 | |
| EP | 0264898 | A2 | 4/1988 | |
| EP | 0586360 | A1 | 3/1994 | |
| FR | 2525877 | A1 | 11/1983 | |
| FR | 2562770 | A1 | 10/1985 | |
| FR | 2895648 | | 7/2007 | |
| GB | 443696 | A | 3/1936 | |
| GB | 494885 | A | 11/1938 | |
| JP | 05016048 | | 1/1993 | |
| JP | H0557786 | A | 3/1993 | |
| JP | H09207149 | A | 8/1997 | |
| JP | 2004105323 | A | 4/2004 | |
| NL | 7714472 | A | 7/1979 | |
| SU | 1639603 | | 4/1991 | |
| WO | 9003744 | A1 | 4/1990 | |
| WO | 0018267 | | 4/2000 | |
| WO | 0211571 | A1 | 2/2002 | |
| WO | 02067712 | A1 | 9/2002 | |
| WO | 2004112525 | A1 | 12/2004 | |
| WO | 2011082275 | A1 | 7/2011 | |

OTHER PUBLICATIONS

International Preliminary Report on Patentability and Written Opinion of the International Searching Authority issued Aug. 18, 2015 in International Patent Application No. PCT/US2014/015921.

International Search Report and Written Opinion for Application No. PCT/US2014/017239, mailed on Oct. 28, 2014.

International Search Report and Written Opinion for Application No. PCT/US2014/017242, mailed on Jun. 2, 2014.

International Search Report and Written Opinion for Application No. PCT/US2014/017240, mailed on Sep. 8, 2014.

Office Action mailed Jun. 11, 2015 in U.S. Appl. No. 13/773,744.

Notice of Allowance mailed Sep. 23. 2015 in U.S. Appl. No. 13/773,744.

Office Action mailed Mar. 26, 2015 in U.S. Appl. No. 13/773,729.

Final Office Action mailed Sep. 1, 2015 in U.S. Appl. No. 13/773,729.

International Preliminary Report on Patentability and Written Opinion of the International Searching Authority issued Sep. 3, 2015 in International Patent Application No. PCT/US2014/017240.

International Preliminary Report on Patentability and Written Opinion of the International Searching Authority issued Sep. 3, 2015 in International Patent Application No. PCT/US2014/017239.

International Preliminary Report on Patentability and Written Opinion of the International Searching Authority issued Sep. 3, 2015 in International Patent Application No. PCT/US2014/017242.

Response to Rule 161 and 162 Communication mailed Nov. 4, 2015 for Application No. EP14712801.1 filed May 28, 2015.

* cited by examiner

LAST WITH RETRACTABLE PINS

BACKGROUND

The present embodiments relate generally to footwear and in particular to a method for making footwear and an associated system.

Lasts, such as footwear lasts, may be used to make footwear. A last may generally have the shape of a foot, including a forefoot portion, a midfoot portion and a heel portion. The last may help provide contouring for the assembled article and helps to create a desired fit.

SUMMARY

In one aspect, the embodiments provide a method of creating an upper for an article of footwear including associating a footwear segment with a last member, where the last member includes a plurality of retractable pins and where the footwear segment includes an extension portion. The method also includes inserting the plurality of retractable pins through holes in the extension portion. The method also includes modifying the footwear segment while the footwear segment is on the last member and removing the extension portion.

In another aspect, the embodiments provide a last member including a plurality of retractable pins extending from an outer surface and a plurality of vacuum holes disposed on the outer surface. The plurality of retractable pins and the vacuum holes are both configured to temporarily hold one or more footwear segments in place on the last member.

In another aspect the embodiments provide a last assembly configured for use with an article of footwear. The last assembly includes a last member having the approximate shape of an article of footwear and a base member associated with a bottom portion of the last member. The base member includes a plurality of vacuum holes.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
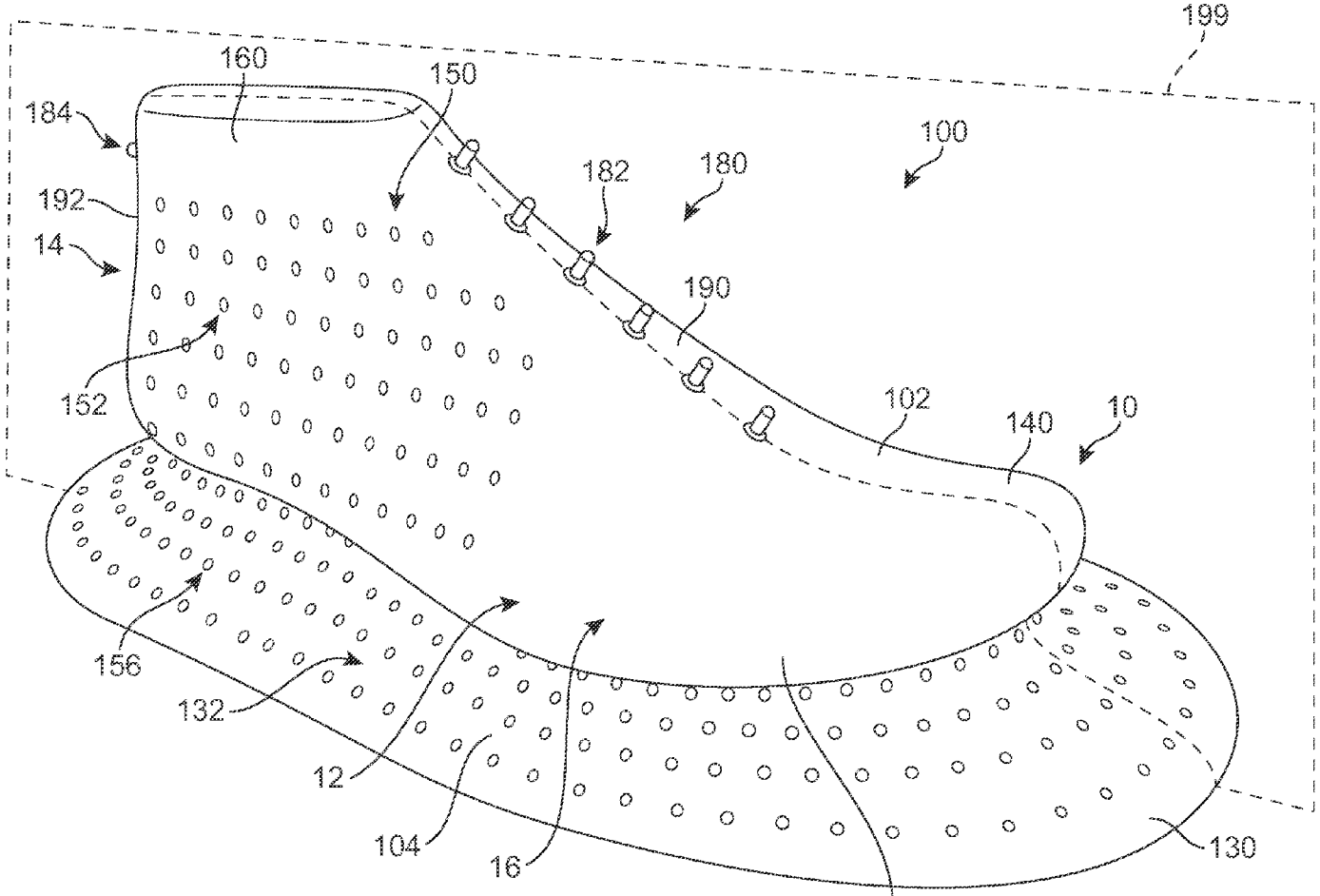
FIG. 1 is a schematic isometric view of a first side of an embodiment of a last assembly.
Figure 2:
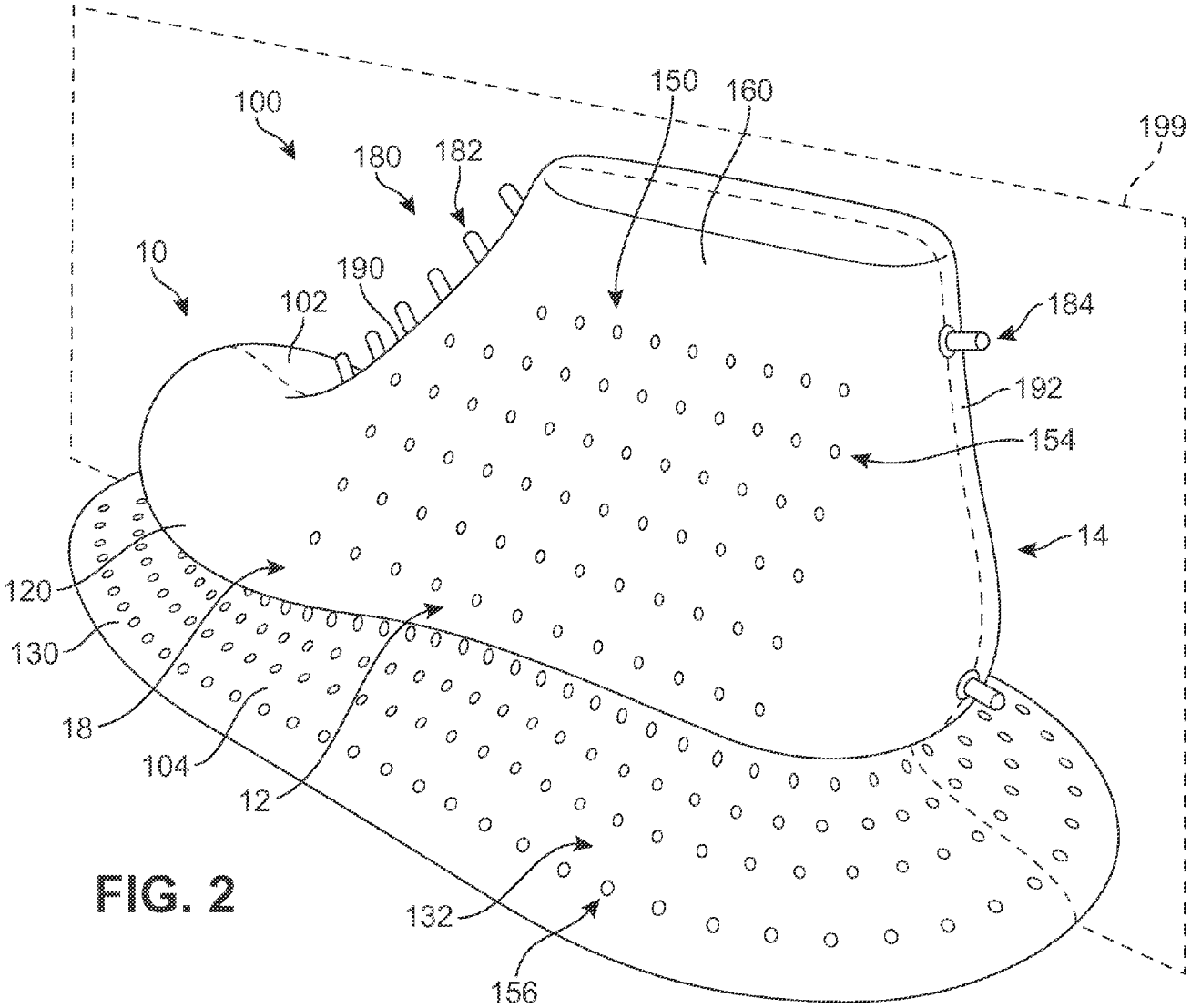
FIG. 2 is a schematic isometric view of a second side of an embodiment of a last assembly.
Figure 3:
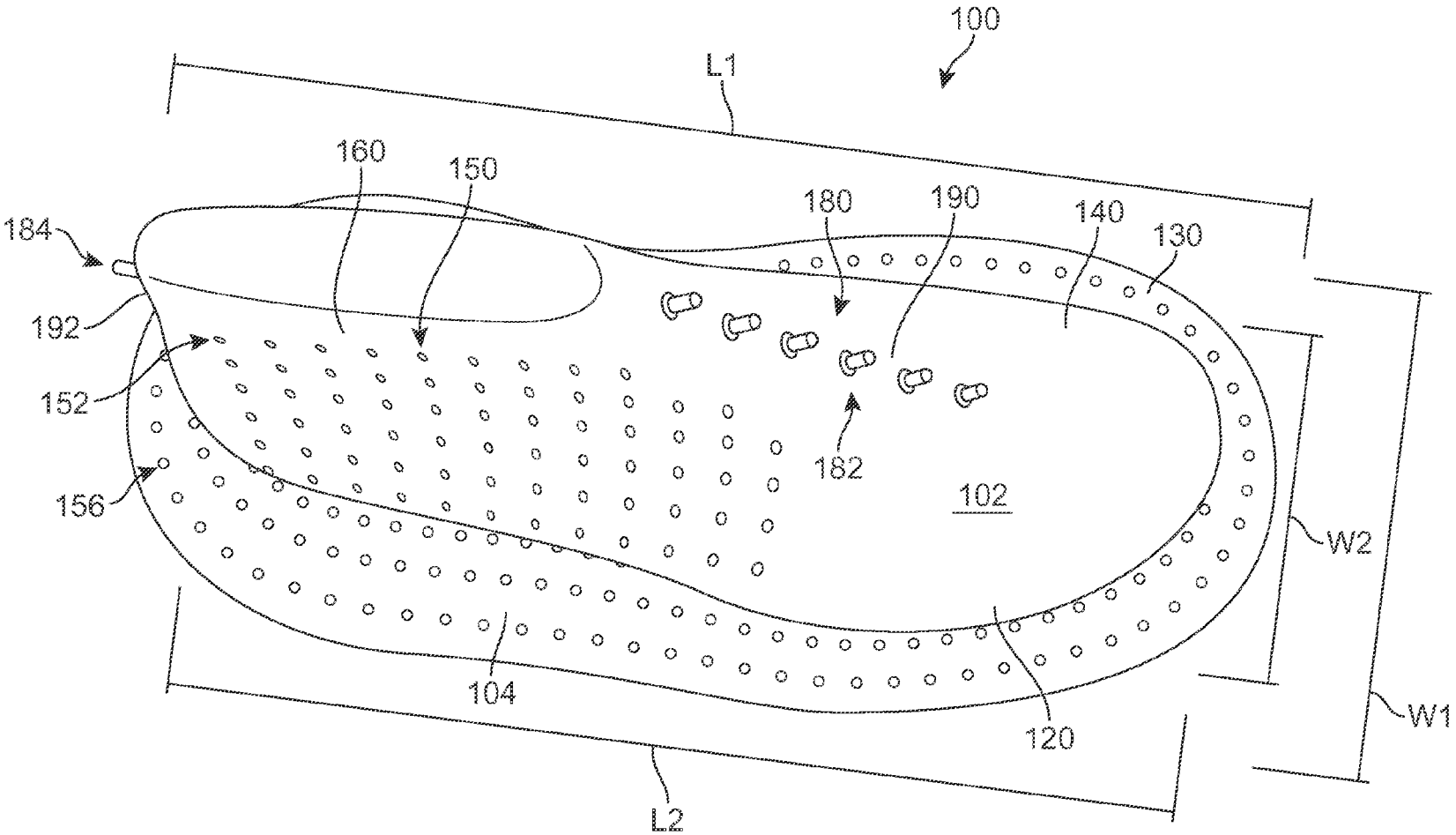
FIG. 3 is a schematic isometric view of a top side of a last assembly.

FIGS. 1 through 3 illustrate schematic isometric views of an embodiment of last assembly 100. Last assembly 100 may be configured for use with various kinds of footwear including, but not limited to: hiking boots, soccer shoes, football shoes, sneakers, rugby shoes, basketball shoes, baseball shoes as well as other kinds of shoes. Moreover, in some embodiments last assembly 100 may be configured for use with various kinds of non-sports related footwear, including, but not limited to: slippers, sandals, high heeled footwear, loafers as well as any other kinds of footwear or apparel.

Referring to FIGS. 1 through 3, last assembly 100 may comprise various components or members. In some embodiments, last assembly 100 can include last member 102 and base member 104. Last member 102 may have the approximate geometry of a footwear last, and may generally be configured to receive materials associated with the upper of an article of footwear. Base member 104 may extend from a lower portion of last member 102 and may generally provide support for last assembly 100.

Referring to FIGS. 1 and 2, for purposes of reference, last member 102 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, last member 102 may include lateral side 16 and medial side 18. In particular, lateral side 16 and medial side 18 may be opposing sides of last member 102. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of last assembly 102. Likewise, lateral side 16 and medial side 18 are intended to represent generally two sides of a component, rather than precisely demarcating last member 102 into two halves.

For consistency and convenience, directional adjectives are employed throughout this detailed description corresponding to the illustrated embodiments. The term "longitudinal" as used throughout this detailed description and in the claims refers to a direction extending a length of a component. In some cases, the longitudinal direction may extend from a forefoot portion to a heel portion of the last member. Also, the term "lateral" as used throughout this detailed description and in the claims refers to a direction extending a width of a last member. In other words, the lateral direction may extend between a medial side and a lateral side of a last member. Furthermore, the term "vertical" as used throughout this detailed description and in the claims refers to a direction that is perpendicular to both the longitudinal and lateral directions. It will be understood that each of these directional adjectives may be also be applied to base member 104 as well.

In different embodiments, the geometry of base member 104 may vary. In some embodiments, base member 104 has a flange-like geometry that is narrower at lower portion 120 of last member 102 and widens to outer peripheral edge 130 of base member 104. For example, in the current embodiment, the length L1 of base member 104 at outer peripheral edge 130 is substantially greater than the length L2 of last member 102 at lower portion 120 (see FIG. 3). Likewise, the width W1 of base member 104 at outer peripheral edge 130 is substantially greater than the width W2 of last member 102 at lower portion 120 (see FIG. 3). Thus, base member 104 provides a wider base for last assembly 100, which may improve stability.

Referring again to FIGS. 1 and 2, in some embodiments, base member 104 may be generally tapered from the region adjacent to lower portion 120 of last member 102 to outer peripheral edge 130. In other words, the outer surface 132 of base member 104 may be sloped towards outer peripheral edge 130. In some cases, outer surface 132 could have a convex geometry. In other cases, outer surface 132 could have a concave geometry. In still other cases, outer surface 132 may be an inclined surface that is approximately flat. Moreover, in still other cases, the curvature of outer surface 132 could vary over different regions. The geometry and more specifically the curvature of outer surface 132 can be varied according to considerations including, for example, desired stability or to enhance engagement with external components, such as the flexible membrane described in detail below.

In some embodiments, last member 102 and base member 104 could be permanently joined. In such embodiments, last member 102 and base member 104 could be integrally formed, for example, during a molding process. In other embodiments, last member 102 and base member 104 could be permanently joined using an adhesive or other permanent means of fastening last member 102 and base member 104. In other embodiments, last member and base member 104 may be removably attached or otherwise fastened. For example, one embodiment could incorporate screws or similar kinds of fasteners for temporarily securing base member 104 to last member 102 in order to enhance versatility for last assembly 100.

Last assembly 100 may include provisions for temporarily holding portions of an article of footwear in place on last member 102. In some embodiments, last assembly 100 may provide a single system for temporarily holding portions of an article in place on last member 102. In other embodiments, last assembly 100 may provide two or more systems for temporarily holding portions of an article in place on last member 102. In one embodiment, for example, last assembly 100 may incorporate two types of provisions that work cooperatively to retain portions of an article on last member 102. This may help in retaining various portions of footwear on last member 102 over a wide range of different operating conditions or stages in a manufacturing process.

Last assembly 100 may include provisions for supplying vacuum pressure along one or more portions. In some embodiments, last assembly 100 may be provided with plurality of vacuum holes 150. In particular, in some cases, plurality of vacuum holes 150 may be incorporated into outer surface 140 of last assembly 100. Each vacuum hole of plurality of vacuum holes 150 may be in fluid communication with a vacuum pump or other source of a vacuum (not shown). Moreover, it should be understood that various means of providing fluid communication between vacuum holes 150 and a vacuum pump or other source could be provided in various embodiments. For example, some embodiments could incorporate internal channels, fluid lines or other means for connecting one or more vacuum holes 150 with a vacuum pump. In some embodiments, some or all of plurality of vacuum holes 150 may be in fluid communication with one or more common vacuum supply channels. In one embodiment, it is contemplated that a single vacuum supply line is introduced at a portion of last assembly 100. This single supply line is then attached in a matter that places it in fluid communication with plurality of vacuum holes 150. However, in some other embodiments a vacuum may not be supplied at a single location, but may be provided at one or more regions of last member 100. In another embodiment, for example, vacuum holes 150 may be in fluid communication with holes on a lower surface of last assembly 100. Thus, regions of low air pressure provided beneath or along the bottom of last assembly 100 may facilitate the pulling of air through vacuum holes 150 and out the through the lower surface of last assembly 100.

In different embodiments, the locations of plurality of vacuum holes 150 could vary. In some embodiments, vacuum holes could be incorporated into last member 102. In other embodiments, vacuum holes could be incorporated into base member 104. In one embodiment, vacuum holes could be incorporated into both last member 102 and base member 104. In some embodiments, plurality of vacuum holes 150 may include first set of vacuum holes 152, second set of vacuum holes 154 and third set of vacuum holes 156.

In the embodiment shown in FIGS. 1-3, first set of vacuum holes 152 and second set of vacuum holes 154 may comprise vacuum holes located along lateral side 16 and medial side 18, respectively, of last member 102. Moreover, in some embodiments, first set of vacuum holes 152 and second set of vacuum holes 154 may extend through heel portion 14 as well as midfoot portion 12, but may not extend into forefoot portion 10. Additionally, third set of vacuum holes 156 may extend through a substantial entirety of base member 104. As described in further detail below, this arrangement may help provide a force necessary to temporarily hold the side portions of an upper in place as well as securing a flexible membrane around the entirety of base member 104.

It will be understood that other embodiments could include vacuum holes in any other portions of last member 102 or base member 104 and could likewise exclude vacuum holes in any portions of last member 102 and/or base member 104. Furthermore, while the current embodiment illustrates a substantially uniform arrangement and spacing for vacuum holes within first set of vacuum holes 152, second set of vacuum holes 154 and third set of vacuum holes 156, other embodiments could incorporate any other arrangements of vacuum holes. For example, in other embodiments the number, size and pattern of vacuum holes could vary. The locations and arrangements could be selected according to various considerations including, but not limited to: required magnitude of forces, curvature of components, intended use for last assembly 100 as well as possibly other considerations.

Last assembly 100 may further include additional provisions for holding one or more portions of an article (or materials used to construct an article) in place. In some embodiments, last assembly 100 may be configured with provisions for engaging features of one or more portions of an article. In one embodiment, last member 102 may include plurality of retractable pins 180. The term "retractable pin" as used throughout this detailed description and in the claims refers to a member or element that projects outwardly from a surface of last member 102. In one embodiment, each retractable pin comprises a pin-like projection that is configured to retract into and extend out of a cavity of last member 102, as discussed in further detail below.

The term retractable pin is not intended to be limiting and may refer to components of varying sizes, geometries and constructions. For example, while the current embodiments illustrate retractable pins 180 as generally cylindrical in shape with rounded tips, other embodiments of retractable pins 180 could have any other geometries. As one example, other embodiments may utilize one or more curved projections or pins, including, in some cases, a rounded hook-like end for catching onto a material.

In different embodiments, the locations of one or more retractable pins could vary. In some embodiments, plurality of retractable pins 180 could be grouped into two or more sets of retractable pins that are disposed on different portions of last member 102. For example, FIGS. 1-3 illustrate an embodiment comprising first set of retractable pins 182 and second set of retractable pins 184 that are disposed on a first portion 190 and a second portion 192, respectively, of last member 102. In some cases, first portion 190 may be an upper instep portion, which extends through the top of midfoot portion 12 and some of forefoot portion 10. In some cases, first portion 190 may be a top portion of last member 102 that is disposed forwards of ankle portion 160. In particular, in some cases, first portion 190 may be associated with the lacing region or lacing area of an article, which generally includes an opening for a tongue and is bordered by eyelets for receiving a shoe lace. In some cases, second portion 192 may be a rearwardly facing portion of heel portion 14. However, other embodiments could utilize sets of retractable pins in any other portions of last member 102. As described in further detail below, the locations of each set of retractable pins may be selected to most effectively hold one or more portions of an article on last member 102.

The arrangement of retractable pins may vary. In some embodiments, for example, retractable pins could be evenly spaced apart in one or more directions along a surface of last member 102. In other embodiments, retractable pins could be grouped in linear arrangements. For example, in the embodiment shown in FIGS. 1-3 first set of retractable pins 182 may be generally arranged as a single row of pins that extends in an approximately longitudinal direction of last member 102. Likewise, in some cases, second set of retractable pins 184 may be generally arranged as a single row of pins that extends in an approximately vertical direction of last member 102. Moreover, in some embodiments, first set of retractable pins 182 and second set of retractable pins 184 may be generally aligned along planar surface 199 (see FIGS. 1 and 2), which intersects last member 102 in an approximately longitudinal direction. In some cases, planar surface 199 may very approximately be seen as bisecting last member 102. In other cases, however, planar surface 199 need not be a bisecting plane and could have any other location or relative orientation.

Figure 4:
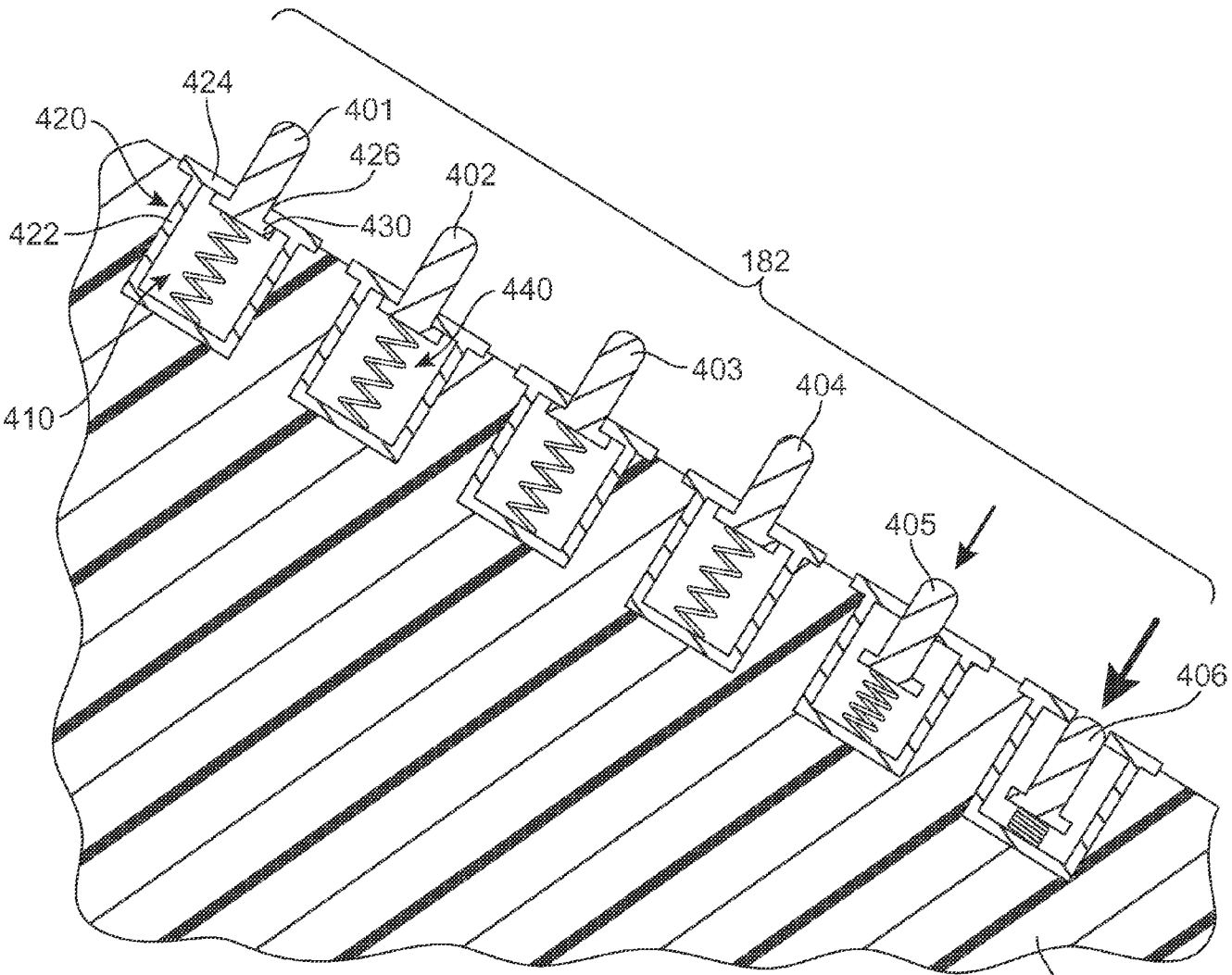
FIG. 4 is a schematic cross-sectional view of an embodiment of portion of a last assembly including a set of retractable pins.

FIG. 4 is a schematic cross sectional view of first set of retractable pins 182 and an adjacent portion of last member 102, according to an embodiment. Referring to FIG. 4, first set of retractable pins 182 may comprise six retractable pins, including first retractable pin 401, second retractable pin 402, third retractable pin 403, fourth retractable pin 404, fifth retractable pin 405 and sixth retractable pin 406. Although the current embodiment includes six retractable pins for first set of retractable pins 182, other embodiments can incorporate any other number retractable pins.

In some embodiments, plurality of retractable pins 180 may be partially housed within interior cavities 410 of last member 102. Each of interior cavities 410 may include cavity walls and a retaining ring for preventing the retractable pins from falling out of the cavity. For example, first retractable pin 401 may be housed within first interior cavity 420, which includes first cavity walls 422 and first retaining ring 424. In particular, first retaining ring 424 may be configured with an aperture 426 that is sized to retain flange portion 430 of first retractable pin 401. Thus, in this case, first retractable pin 401 may be inserted into, and partially extended from, first interior cavity 420, but first retractable pin 401 is prevented from completely being pulled out of first interior cavity. It will be understood that the various dimensions, geometries and other properties of interior cavities 410 can vary in different embodiments according to, for example, the sizes, shapes and other properties of first set of retractable pins 182.

In some embodiments, plurality of retractable pins 180, including first set of retractable pins 182, may be biased so as to be normally in an extended position. In some embodiments, plurality of retractable pins 180 may be spring biased. For example, as seen in FIG. 4, each retractable pin of first set of retractable pins 182 is associated with a corresponding spring of first set of springs 440, which act to bias first set of retractable pins 182 in the extended position. In other embodiments, however, other provisions for biasing first set of retractable pins could be used, and the type of biasing used could be selected according to the desired biasing force, dimensions of the corresponding interior cavities as well as other considerations. Moreover, the biasing force provided by a spring or other biasing means can be varied in any manner known in the art.

It will be understood that second set of retractable pins 184 may be associated with similar provisions as first set of retractable pins 182. For example, second set of retractable pins 184 may be associated with a corresponding set of interior cavities that allow for the retraction and partial extension of second set of retractable pins 184. Likewise, second set of retractable pins 184 may be associated with a corresponding set of springs for biasing second set of retractable pins 184.

As described above, plurality of retractable pins 180 can be used to help retain one or more portions of an article, or materials used in constructing an article, on last member 102. Additionally, in some cases, plurality of retractable pins 180 may help to ensure proper alignment of one or more portions of an article on last member 102.

FIGS. 5 through 15 illustrate schematic views of a process for constructing an upper using last assembly 100. In particular, FIGS. 5 through 15 illustrate steps of permanently bonding or otherwise joining two or more segments of material together as the material is disposed on last assembly 100. It should be understood, however, that the following method is intended to be exemplary and the uses for last assembly 100 are not limited to such footwear construction methods. Generally, last assembly 100 may be used with any system and/or method for creating articles that makes use of a last of some kind. In another embodiment, for example, last assembly 100 could be used with a system and method of creating graphics on an upper or portion of an article. An example of such a method is disclosed in Hull, U.S. Pat. No. 8,162,022, filed Oct. 3, 2008, and titled "Method of Customizing an Article and Apparatus", the entirety of which is hereby incorporated by reference.

Figure 5:
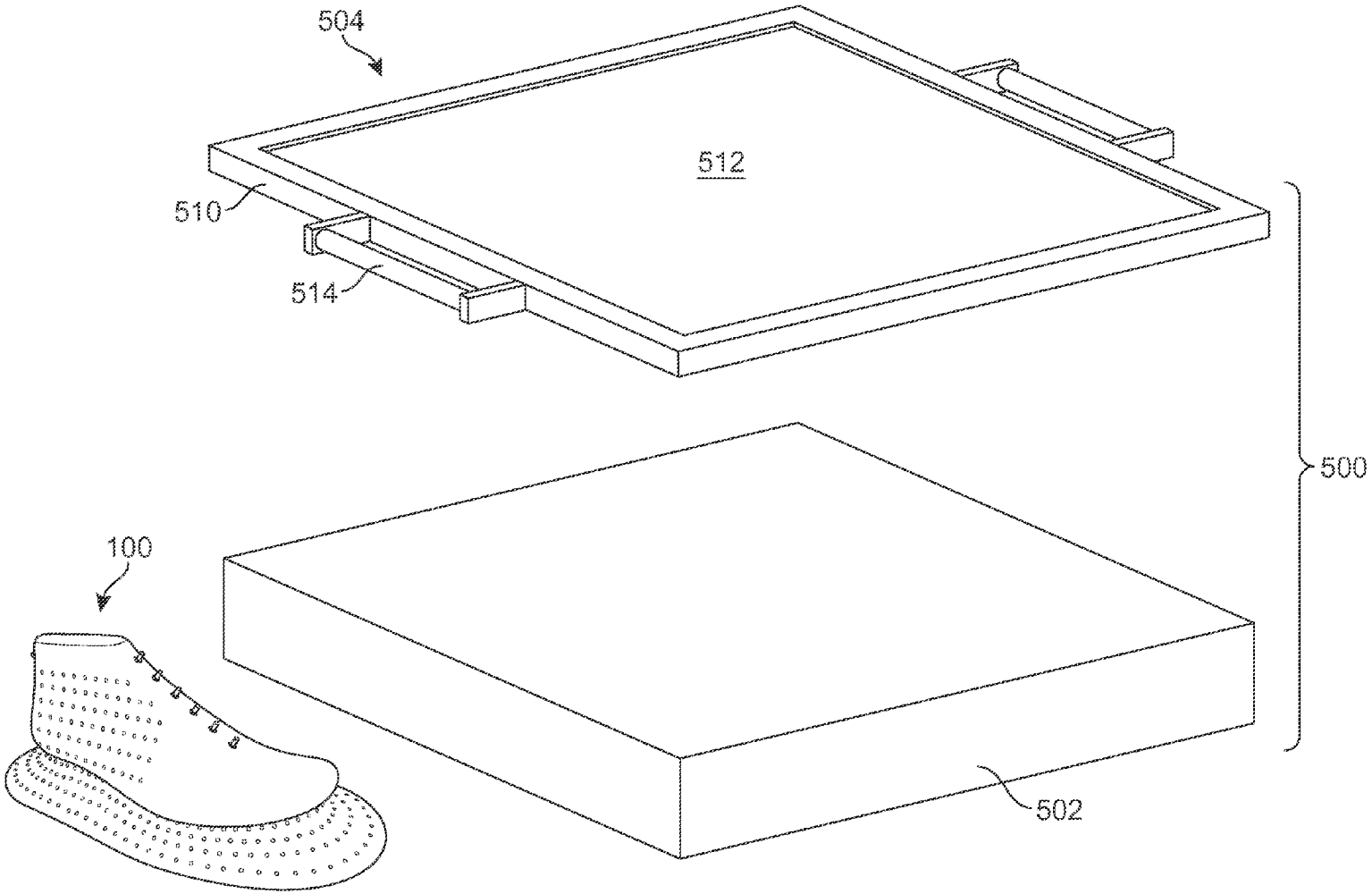
FIG. 5 is a schematic view of an embodiment of a footwear pressure system for use with a last assembly.

FIG. 5 illustrates a schematic view of components of a footwear pressing system 500, which may be used in conjunction with last assembly 100, according to an embodiment. Referring to FIG. 5, footwear pressing system 500 includes provisions for applying pressure over one or more regions of an article of footwear or portion of an article of footwear disposed on last assembly 100. In some embodiments, footwear pressing system 500 may be configured to provide pressure over last assembly 100.

In some embodiments, footwear pressing system 500 may include a base platform 502 and a pressing assembly 504. In some cases, base platform 502 may comprise a substantially flat rectangular surface. In other cases, base platform 502 could have any other geometry and could include provisions for receiving a last assembly, such as one or more recessed portions into which a portion of a last may be fit. Pressing assembly 504 may be configured to fit over base platform 502. In some embodiments, pressing assembly 504 comprises an outer frame member 510 and a flexible membrane 512 that is mounted within the outer frame member 510. As shown in FIG. 5, in some embodiments outer frame member 510 may include handles 514 that facilitate ease of handling.

In different embodiments, the materials used for flexible membrane 512 could vary. Examples of flexible materials that may be used include, but are not limited to: flexible textiles, natural rubber, synthetic rubber, silicone, elastomers, other elastomers such as silicone rubber, as well as other materials known in the art.

For purposes of clarity, only some provisions of footwear pressing system 500 are shown in the Figures. However, in other embodiments, additional provisions could be provided. Examples of additional provisions include, but are not limited to, provisions for supplying a vacuum between pressing assembly 504 and base platform 502, provisions for applying heat to objects in contact with flexible membrane 512, provisions for supplying power to components of footwear pressing system 500, control buttons, fasteners for clamping pressing assembly 504 and base platform 502 together as well as any other provisions. Examples of such provisions are discussed and illustrated in various embodiments in the Method of Customizing an Article and Apparatus application.

Figure 6:
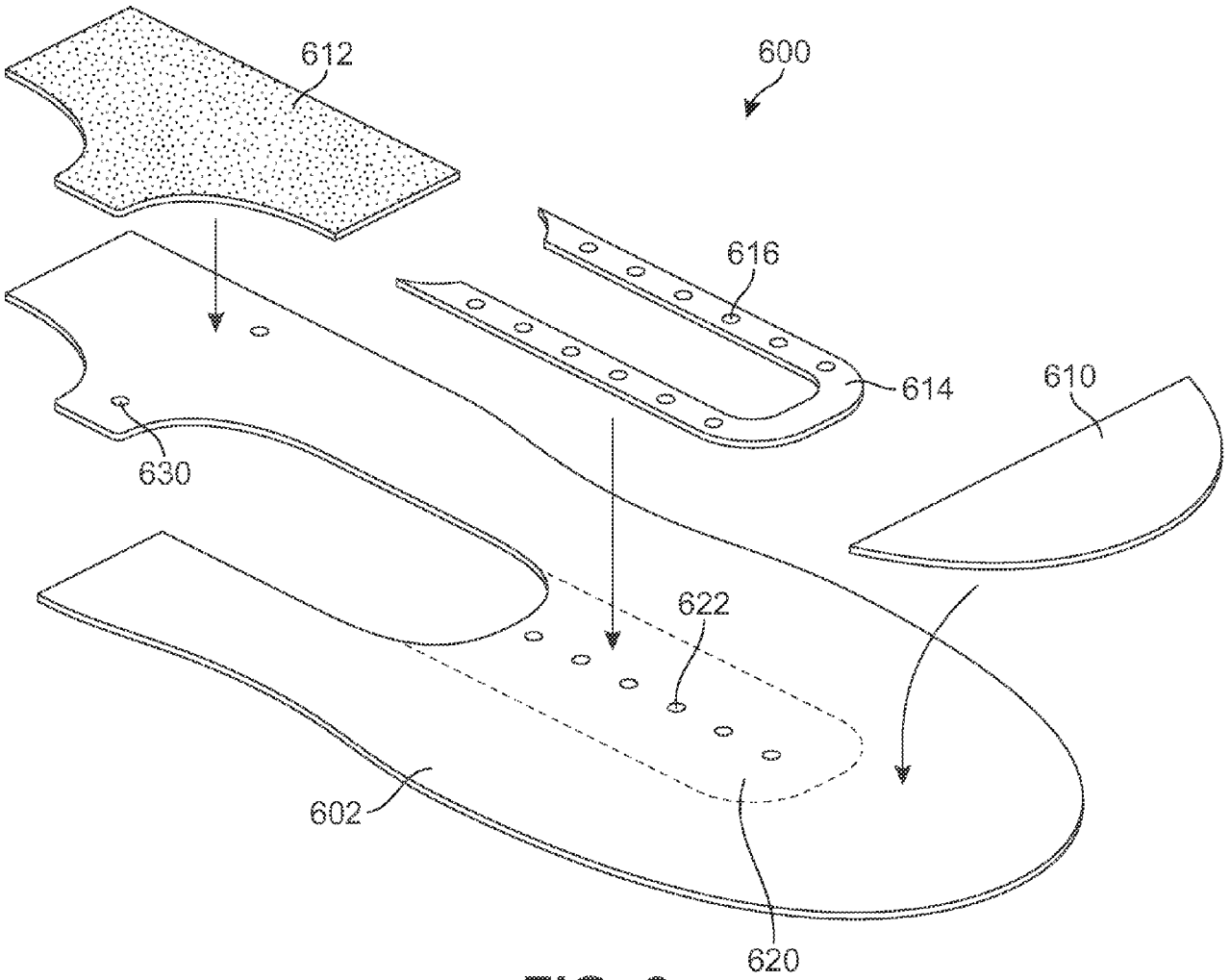
FIG. 6 is a schematic isometric view of an embodiment of a plurality of footwear segments.

FIG. 6 illustrates a schematic isometric view of an embodiment various footwear segments that may be used with last assembly 100 and footwear pressing system 500. The term "footwear segment" as used throughout this detailed description and in the claims refers to any segment of material that may be used in making, or otherwise modifying, an article of footwear. In some embodiments, a footwear segment may comprise a textile segment that is used for constructing a portion of an article, such as an upper. The term segment may include portions of material used in creating the base layer or portion of an upper as well as trim pieces which could be decorative and/or functional.

Referring first to FIG. 6, plurality of footwear segments 600 may comprise several distinct segments that are intended to be assembled together to form an upper for an article of footwear. Plurality of footwear segments 600 may include body segment 602, which is configured to form the body or base layer of an upper. In some cases, body segment 602 is formed as a two-dimensional layer that may be later formed into a three-dimensional upper.

Plurality of footwear segments 600 may also include several trim segments, including toe segment 610, heel segment 612 and eyestay segment 614. In one embodiment, eyestay segment 614 may comprise eyelets 616 corresponding to the lateral and medial edges of the lacing region of the upper.

In some embodiments, one or more segments can include provisions for engaging portions of a last member. In one embodiment, body segment 602 is configured with extension portion 620. In some cases, extension portion 620 may be integrally formed with body segment 602. In one embodiment, for example, extension portion 620 may comprise a portion of body segment 602 that is associated with the lacing region of an upper as well as the area where a tongue may be placed. In other cases, however, extension portion 620 could be a distinct portion from body segment 602.

Extension portion 620 may include holes for engaging one or more retractable pins of last member 102. In some embodiments, extension portion 620 includes first set of holes 622 that are configured to first set of retractable pins 182 of last member 102 (see FIG. 3). In some embodiments, body segment 602 further includes provisions for engaging with second set of retractable pins 184. In some embodiments, body segment 602 includes second set of holes 630 that are configured to engage second set of retractable pins 184 of last member 102.

Footwear segments can comprise different materials. Examples of materials that may be used include, but are not limited to: various textile materials, natural leathers, synthetic leathers, woven materials, non-woven materials, plastic materials as well as any other kinds of materials.

Figure 7:
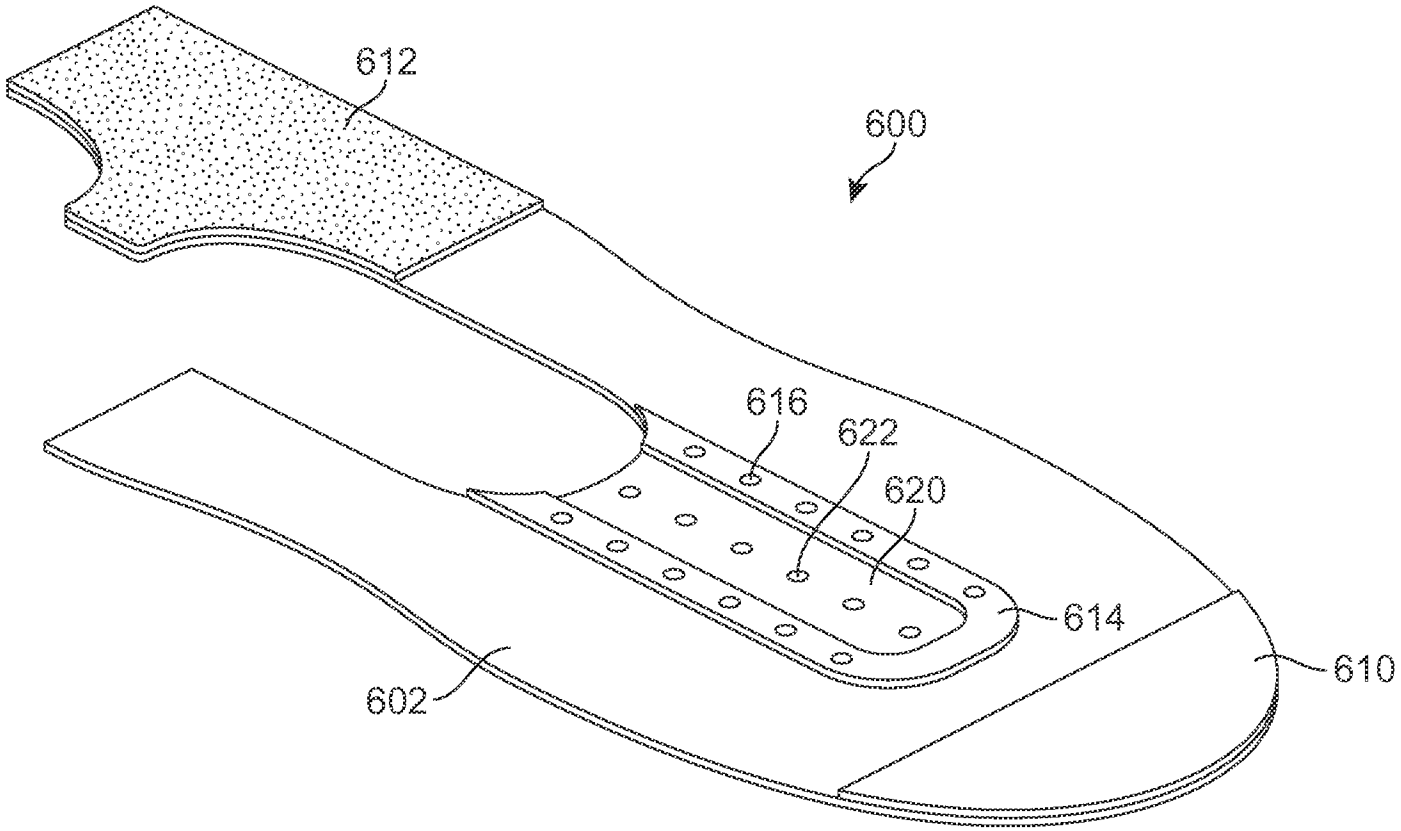
FIG. 7 is a schematic isometric view of an embodiment of a plurality of footwear segments.

FIGS. 7 through 15 illustrate a method of forming a footwear upper from plurality of footwear segments 600, using last assembly 100 and footwear pressing system 500. Referring first to FIG. 7, various trim segments may be associated with body segment 602 prior to placing plurality of footwear segments 600 onto last assembly 100. In some cases, the trim segments may simply be placed or laid at various locations of body segment 602. In other cases, the trim segments can be temporarily bonded to body segment 602 using, for example, a bonding agent or any other means known in the art for temporarily fixing two or more textile materials together. In other embodiments, body segment 602 may be placed on last assembly 100 prior to associating the trim segments with body segment 602.

Figure 8:
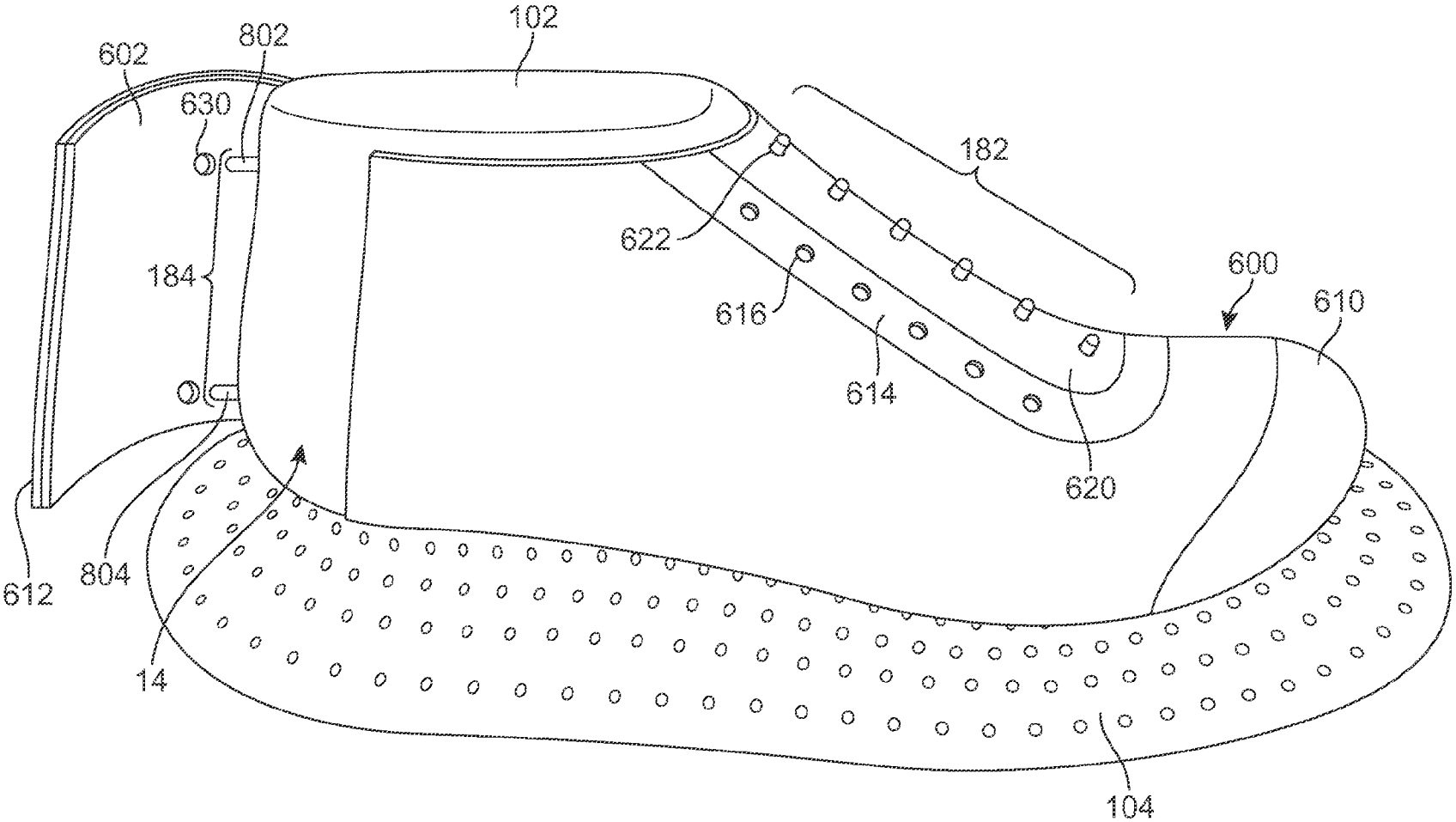
FIG. 8 is a schematic side isometric view of an embodiment of a plurality of footwear segments being placed on a last assembly.
Figure 9:
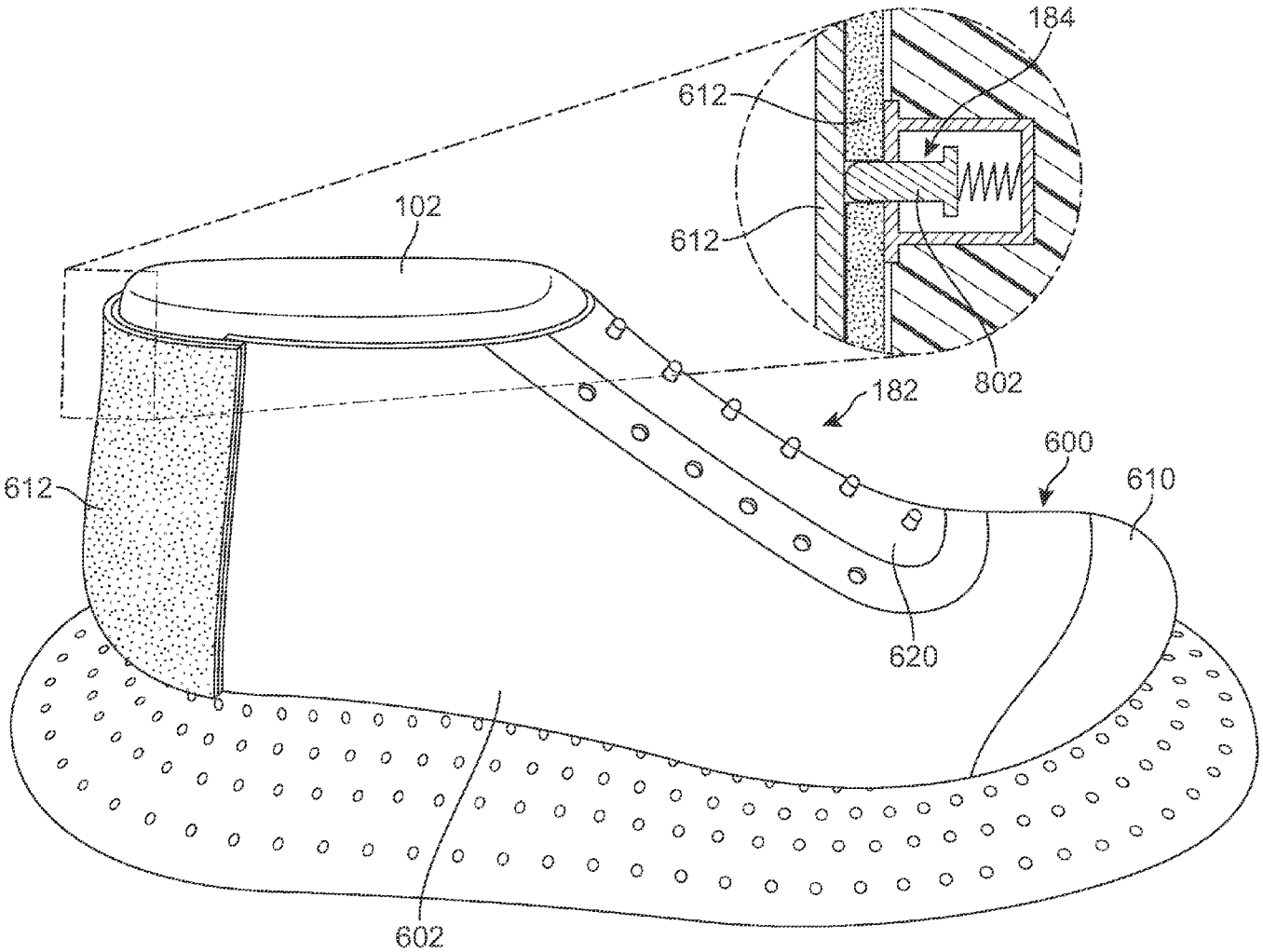
FIG. 9 is a schematic isometric view of an embodiment of a plurality of footwear segments placed on a last assembly.

Referring next to FIGS. 8 and 9, body segment 602 may be placed onto last member 102 so that first set of retractable pins 182 are inserted through first set of holes 622 of extension portion 620. Likewise, second set of holes 630 may be aligned with, and receive, second set of retractable pins 184. As seen in FIG. 9, as body segment 602 wraps around heel portion 14 of last member 102, first retractable pin 802 and second retractable pin 804 (not shown in FIG. 9) of second set of retractable pins 184 may be depressed into last member 102. Moreover, as seen in FIG. 9, due to the presence of heel segment 612, second set of retractable pins 184 may be partially contracted and may not extend outwardly from second set of holes 630.

Figure 10:
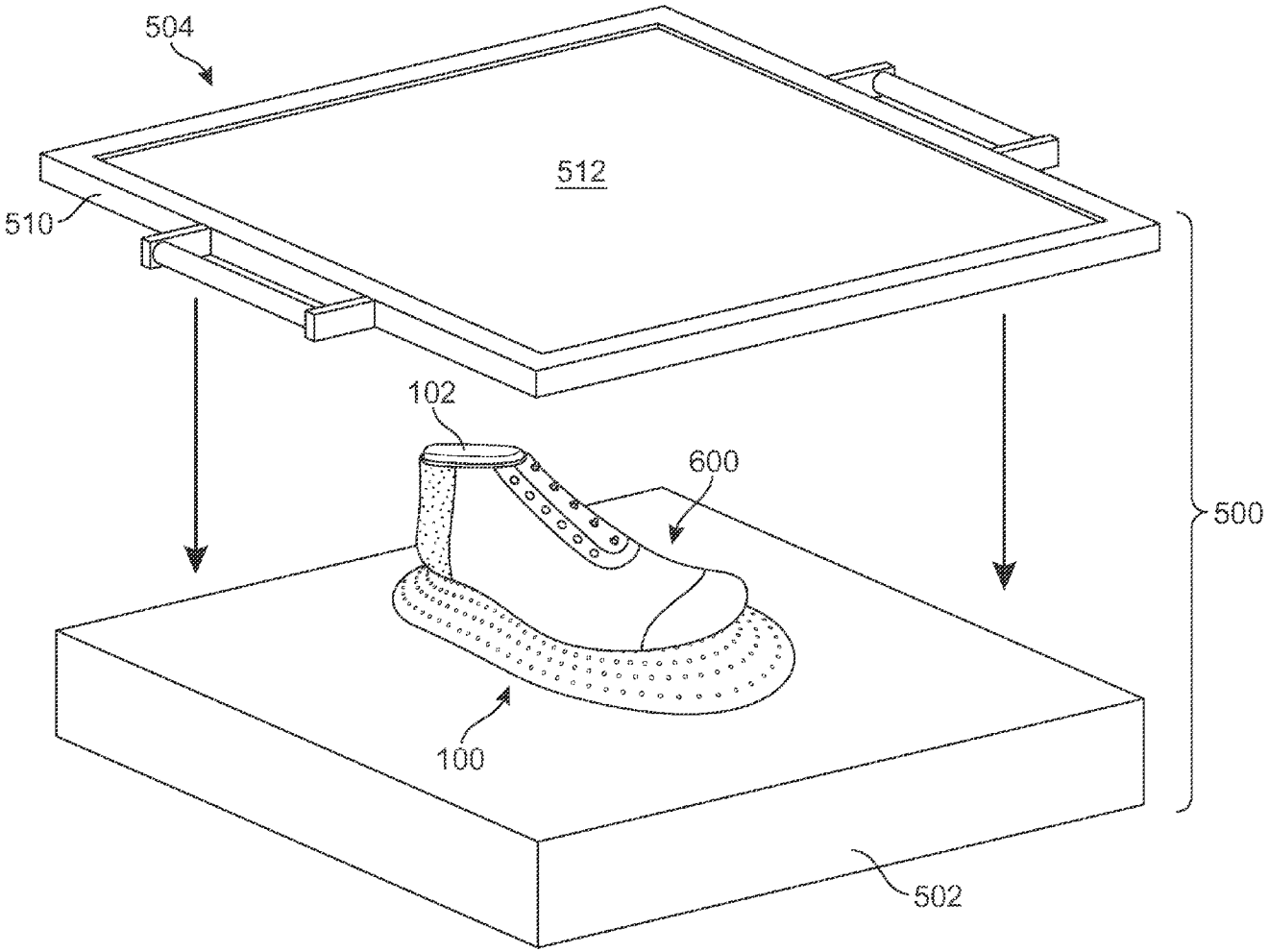
FIG. 10 is a schematic view of an embodiment of a last assembly with a plurality of footwear segments being placed in a footwear pressure system.
Figure 11:
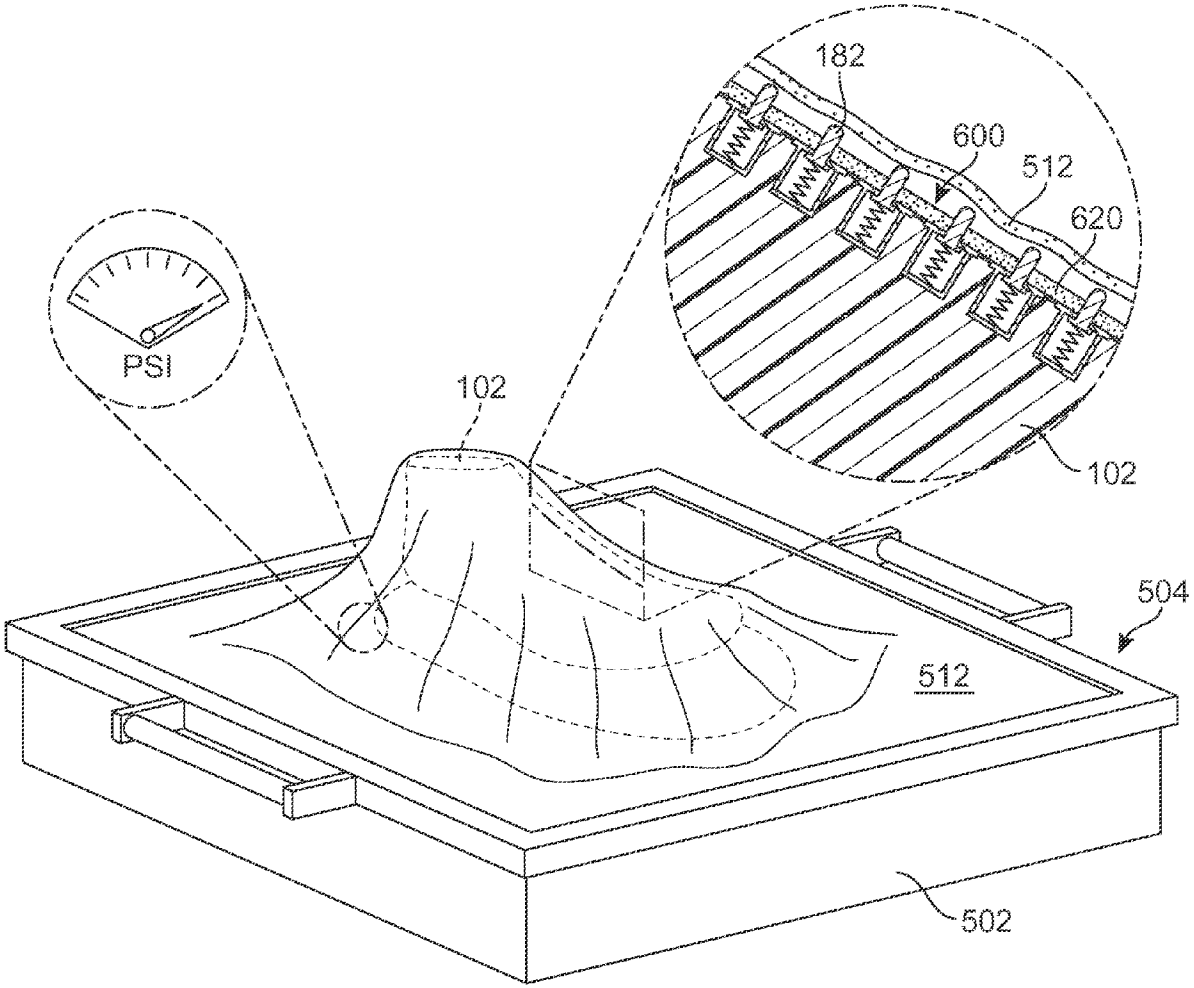
FIG. 11 is a schematic view of an embodiment of a footwear pressure system with a pressing assembly placed over a last assembly and corresponding plurality of footwear segments.

Next, as seen in FIG. 10, last assembly 100, along with plurality of footwear segments 600, may be placed on base platform 502. In addition, pressing assembly 504 may be aligned with base platform 502. As seen in FIG. 11, as pressing assembly 504 is placed over base platform 502, flexible membrane 512 may flex around last member 102 and plurality of footwear segments 600. In this case, flexible membrane 512 may apply a force to first set of retractable pins 182. This force may be enough to partially or even fully retract first set of retractable pins 182.

Figure 12:
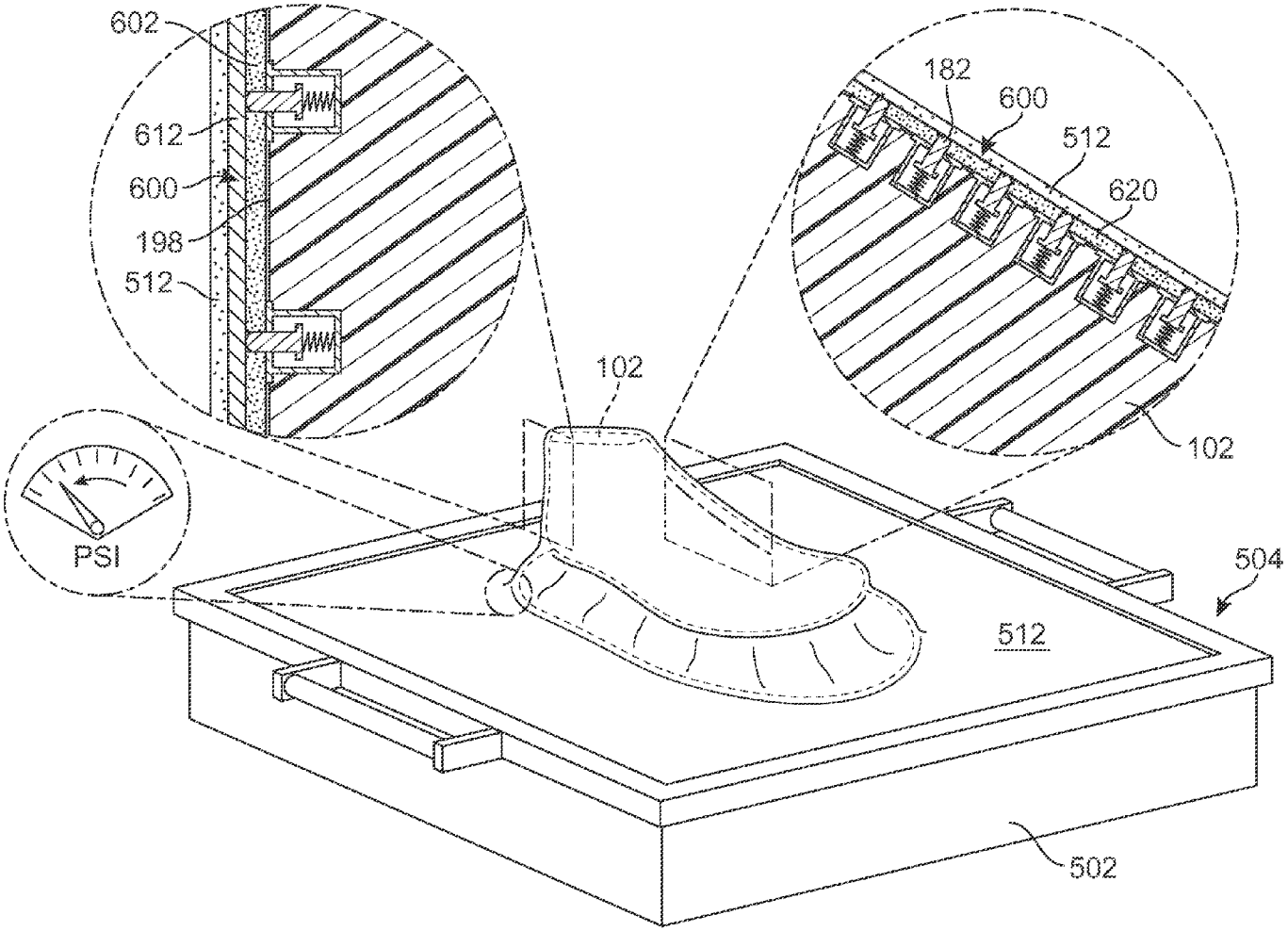
FIG. 12 is a schematic isometric view of an embodiment of a footwear pressure system with a pressing assembly placed over a last assembly and corresponding plurality of footwear segments, where a vacuum has been applied within the footwear pressure system.

Referring now to FIG. 12, a vacuum may be applied between flexible membrane 512 and base platform 502. As the pressure between flexible membrane 512 and base platform 502 decreases, the environment may apply a force that presses flexible membrane 512 against plurality of footwear segments 600. This has the effect of compressing plurality of footwear segments 600 between flexible membrane 512 and last member 102, which may help fuse adjacent footwear segments together. In some cases, further fusing can be facilitated by applying heat, which may be applied by flexible membrane 512 or a separate heat source.

The configuration described here may help to minimize local stresses applied by retractable pins at regions of flexible membrane 512. In particular, the spring biased retractable pins 180 are able to fully retract within last member 102 as flexible membrane 512 tightens against plurality of footwear segments 600 and last assembly 100. This arrangement can help reduce the tendency of flexible membrane 512, which could be substantially fragile in some cases, to tear or rupture.

Figure 13:
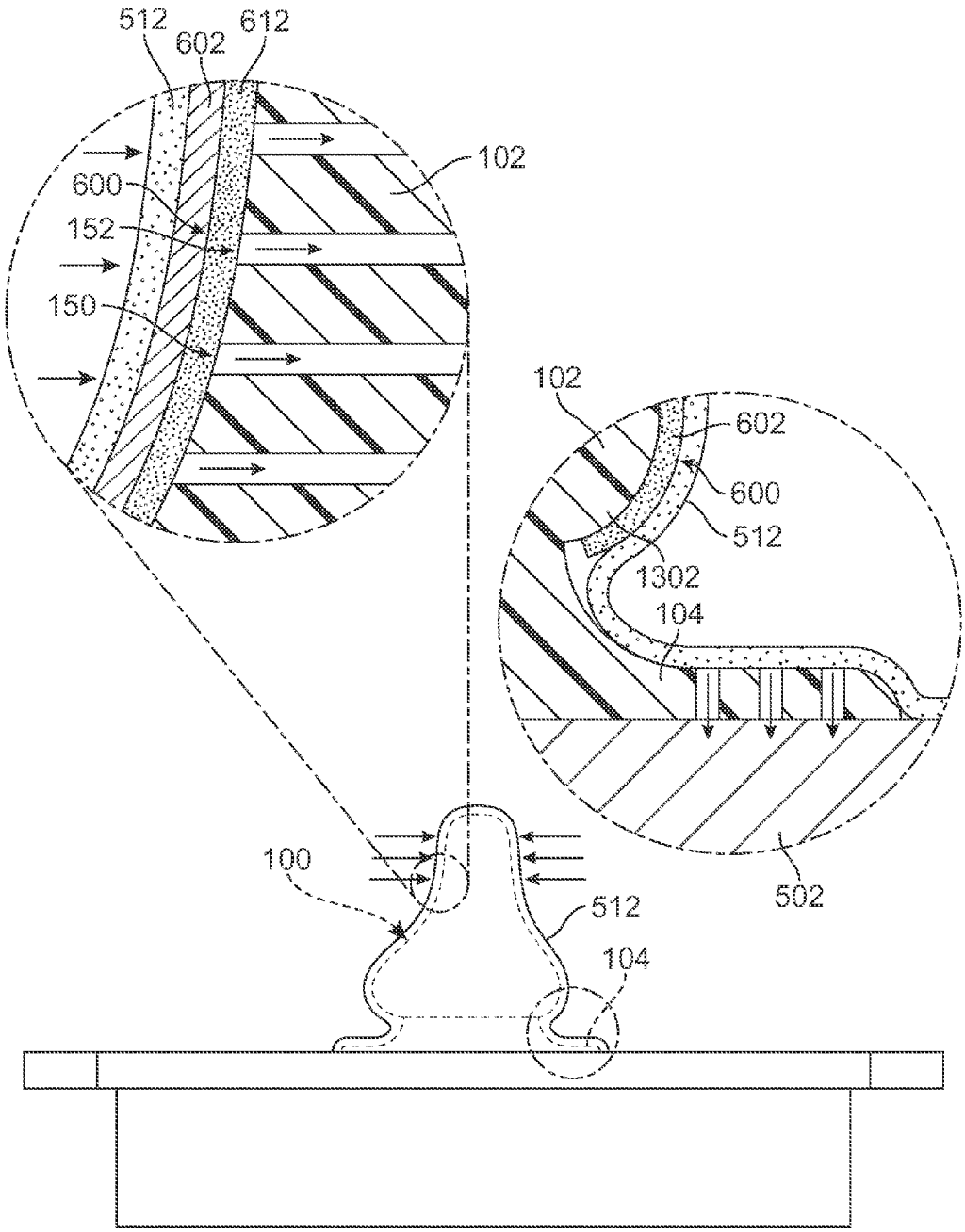
FIG. 13 is a front schematic view of an embodiment of a footwear pressure system with a pressing assembly placed over a last assembly and corresponding plurality of footwear segments, where a vacuum has been applied within the footwear pressure system.

As seen in FIG. 13, plurality of vacuum holes 150 may help ensure that plurality of footwear segments 600 stay in place on last assembly 100, which may be especially important once plurality of retractable pins 180 have been fully retracted (as shown in FIG. 12). For purposes of clarity, FIG. 13 illustrates enlarged cross sections of two regions where plurality of vacuum holes 150 are disposed on last member 102. However, it will be understood that this discussion may equally apply for other regions of last assembly 100 including vacuum holes.

In some embodiments, plurality of vacuum holes 150 may provide areas where flexible membrane 512 presents an increased inward force to hold plurality of footwear segments 600 in place on last assembly 100. For example, first set of vacuum holes 152 extend inwardly and provide a path for air trapped between the various layers to flow to a region of lower air pressure. This causes flexible membrane 512 (which is under the force of the ambient air) to push inwardly, compressing plurality of footwear segments 600 against last member 102 in the vicinity of first set of vacuum holes 152. A similar effect may occur in the vicinity of second set of vacuum holes 154. This configuration creates regions on either side of last member 102 where the pressure of flexible membrane 512 is strong enough to hold plurality of footwear segments 600 in place. This helps to ensure that plurality of footwear segments 600 stays in place on last member 102 while the pressure (and possibly heat) applied by pressing assembly 504 facilitates fusing between various footwear segments (such as heel segment 612 and body segment 602).

In some embodiments, third set of vacuum holes 156 may provide a path for air trapped between flexible membrane 512 and base member 104 to travel to a region of lower air pressure. This causes flexible membrane 512 (which is under the force of the ambient air) to wrap tightly over base member 104. Moreover, the geometry of base member 104 helps facilitate a smooth transition for flexible membrane 512 between last assembly 100 and base platform 502. In particular, the contoured shape of base member 104 allows flexible membrane 512 to gently curve down from lower peripheral edge 1302 of last member 102, over base member 104 and onto base platform 504. This arrangement may help avoid abrupt folds, sharp bends or edges in flexible membrane 512 that may impede the strength of the applied vacuum in the vicinity of last assembly 100 or which may possibly damage flexible membrane 512.

Figure 14:
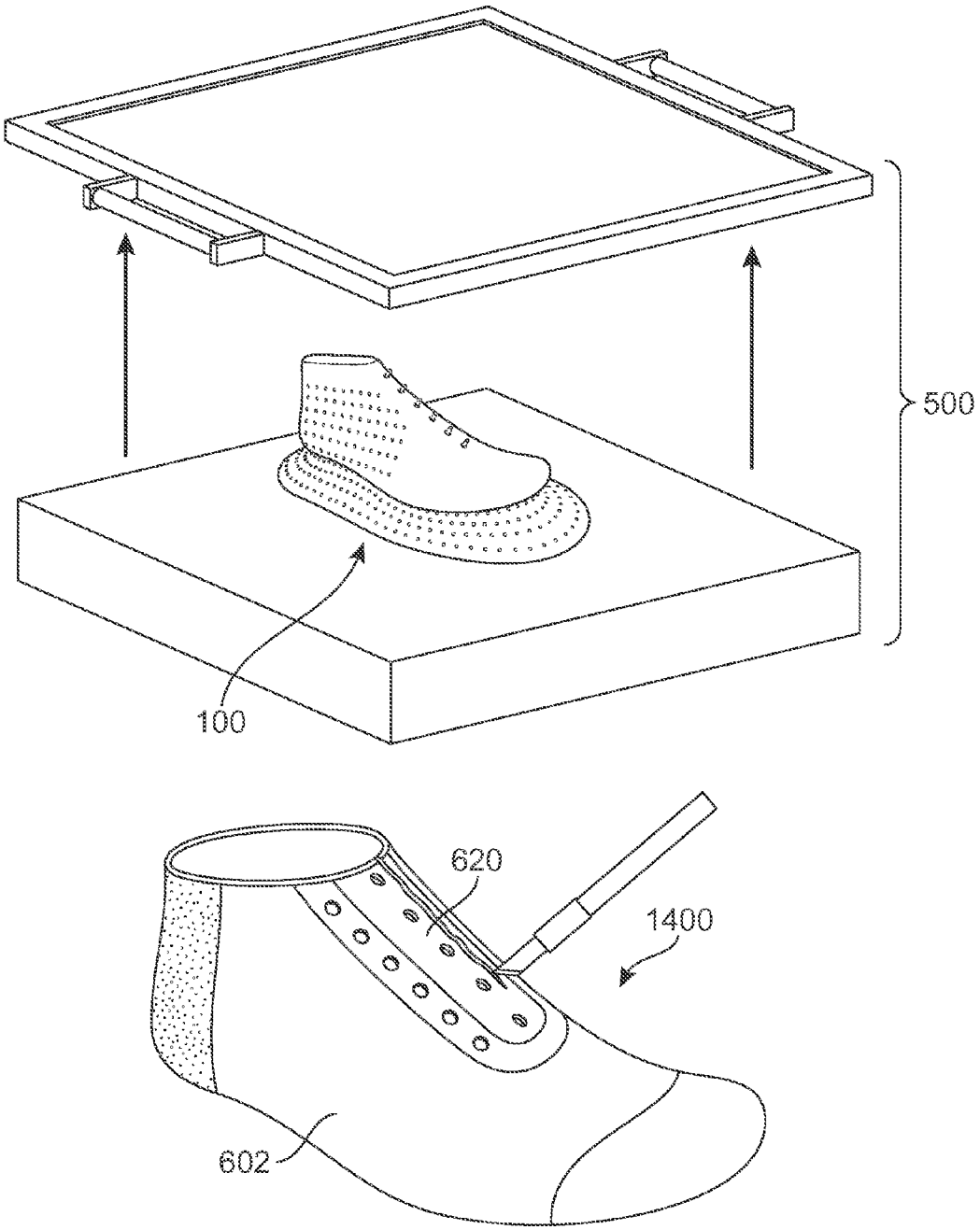
FIG. 14 is a schematic view of an embodiment of a process for removing an extension portion associated with a footwear segment.
Figure 15:
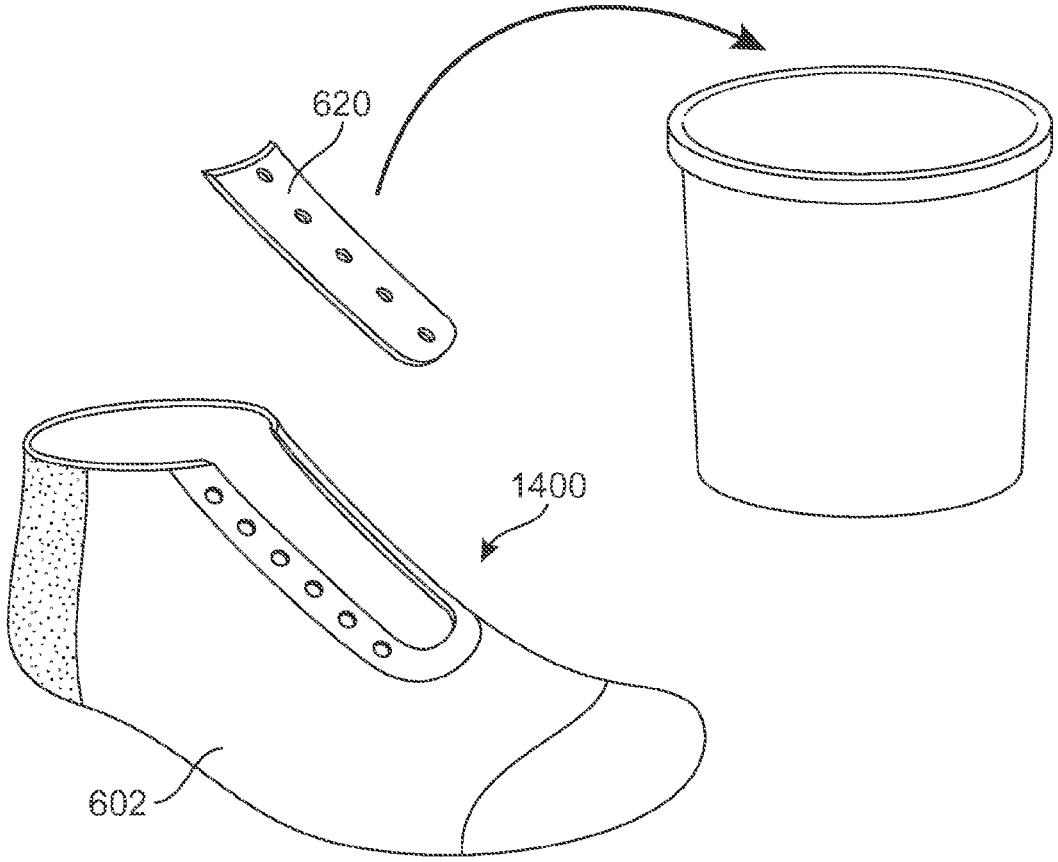
FIG. 15 is a schematic view of an embodiment of a process for discarding a removed extension portion.

FIGS. 14 and 15 illustrate schematic views in a process for making an upper according to the current embodiments. Referring to FIGS. 14 and 15, after pressing (and possibly heating) plurality of footwear segments 600 on last assembly 100, a formed upper 1400 may be removed from last assembly 100. At this point, in order to prepare formed upper 1400 for assembly with a tongue, extension portion 620 may be removed. In particular, as seen in FIG. 14, extension portion 620 may be separated from body segment 602 of formed upper 1400 (for example, using a razor or other cutting device) and then discarded (as seen in FIG. 15).

The embodiments shown here illustrate how last assembly 100 provides means for holding footwear segments in place on last member 102 during two different stages of a manufacturing process. In particular, during a first stage in which footwear segments are placed onto last member 102, plurality of retractable pins 180 function to hold the footwear segments on last member 102. Next, during a second stage in which a flexible membrane acts to depress the plurality of retractable pins 180, plurality of vacuum holes 150 function to hold the footwear segments on last member 102. This arrangement helps to maintain the placement and alignment of footwear segments on last member 102 throughout the manufacturing process, which enhances accuracy and efficiency of the process.

Figure 16:
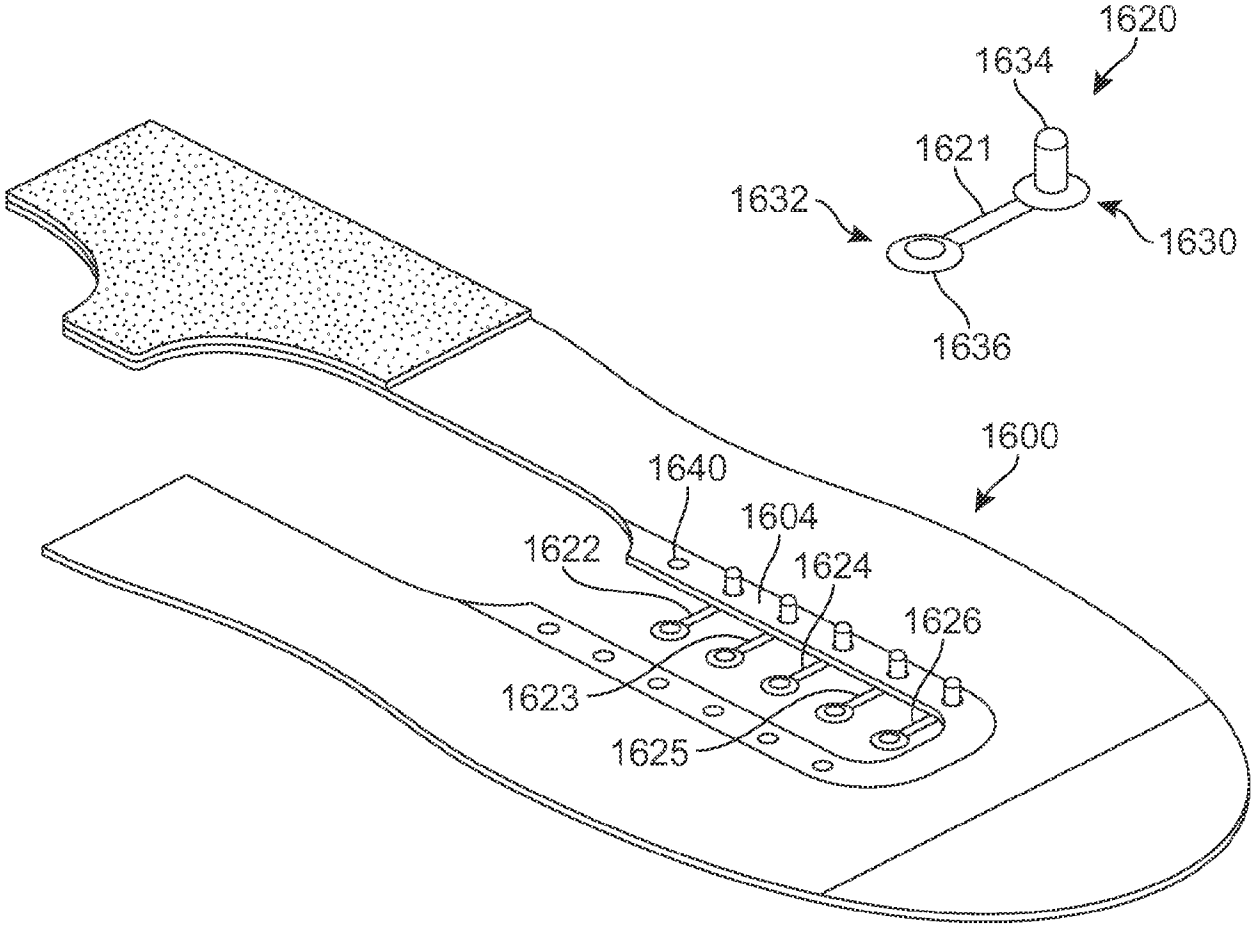
FIG. 16 is a schematic view of an embodiment of a plurality of footwear segments and associated extension portions.
Figure 17:
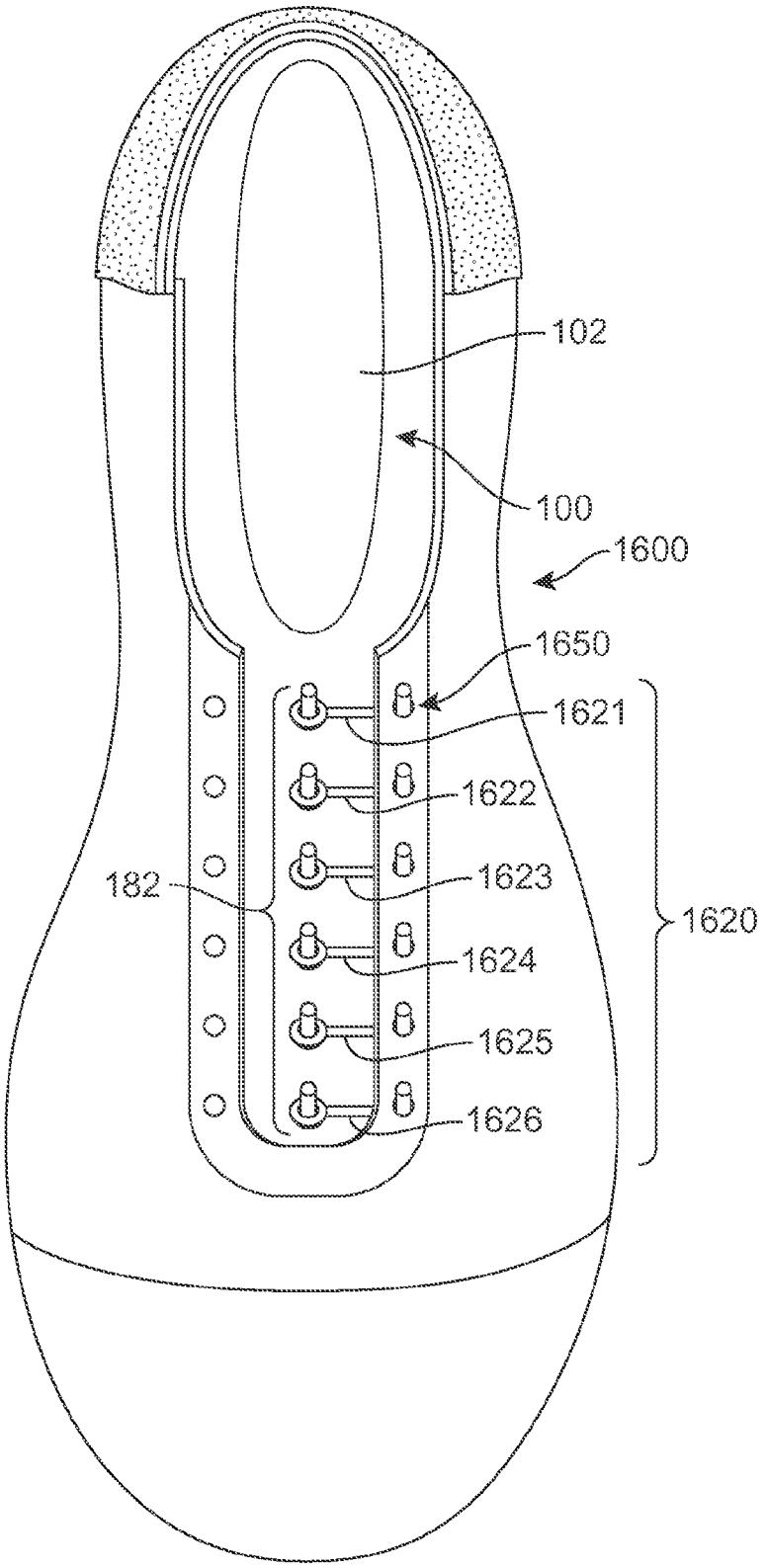
FIG. 17 is a schematic view of an embodiment of a plurality of extension portions being used to temporarily connect a plurality of footwear segments with a plurality of retractable pins.

FIGS. 16 and 17 illustrate schematic views of another embodiment of extension portions that can be used for temporarily securing footwear segments onto a last assembly. Referring to FIGS. 16 and 17, plurality of footwear segments 1600 may be similar in many respects to plurality of footwear segments 600 described above. However, in contrast to body segment 602 of the previous embodiment, the embodiment of FIGS. 16 and 17 is open in the region bordered by eyestay segment 1604. In order to wrap plurality of footwear segments 1600 onto a last assembly, the current embodiment makes use of detachable extension portions, which can be added and removed to plurality of footwear segments 1600 as discussed below.

Referring first to FIG. 16, the current system can include a plurality of extension portions 1620. For purposes of clarity, six extension portions are shown here, including first extension portion 1621, second extension portion 1622, third extension portion 1623, fourth extension portion 1624, fifth extension portion 1625 and sixth extension portion 1626. Other embodiments can include any other number of extension portions. In some cases, the number of extension portions may generally be equal to the number of pairs of eyelets of eyestay segment 1604.

The details of the extension portions are described with respect to first extension portion 1621, however it may be understood that other extension portions of plurality of extension portions 1620 may include substantially similar provisions in some embodiments. First extension portion 1621 may comprise a first end portion 1630 and a second end portion 1632. First end portion 1630 may comprise a pin-like projecting portion 1634. In some cases, projecting portion 1634 may be configured to fit within eyelet 1640 of eyestay segment 1604. Second end portion 1630 may include ring 1636. In some cases, ring 1636 may be configured to receive a retractable pin of last assembly 100.

As seen in FIG. 17, to temporarily hold plurality of footwear segments 1600 on last member 102, plurality of extended portions 1620 may be attached to plurality of eyelets 1650 at their first end portions and attached to corresponding retractable pins of first set of retractable pins 182 at their second end portions. Thus, plurality of extension portions 1620 provide a means of temporarily associating plurality of eyelets 1650 with first set of retractable pins 182, which are otherwise not aligned with one another due to the generally central placement of first set of retractable pins 182.

The embodiments described here and shown in FIGS. 16 and 17 provide extension portions that can be reused. This arrangement may allow the same set of extension portions to be used with multiple different sets of footwear segments to decrease manufacturing costs. Moreover, while the current embodiment illustrates the use of extension portions with a single pin for engaging eyelets on one side of a footwear segment, other embodiments could use two pins to engage a pair of eyelets simultaneously. For example, in one embodiment, an extension portion comprises pins at either end for inserting into corresponding eyelets, and a central ring for engaging a retractable pin. In still another embodiment, two separate extension portions can be used for fastening opposing eyelets to the same central retractable pin.

A last assembly can include provisions for improving the ease with which materials can be associated with a last member. In some embodiments, a last member could be separable from a base member, which allows upper materials to be easily associated a lower periphery of the last member. In embodiments where the last member and base member are separable, the last assembly can include provisions for quickly and easily associating the last member and the base member.

Figure 18:
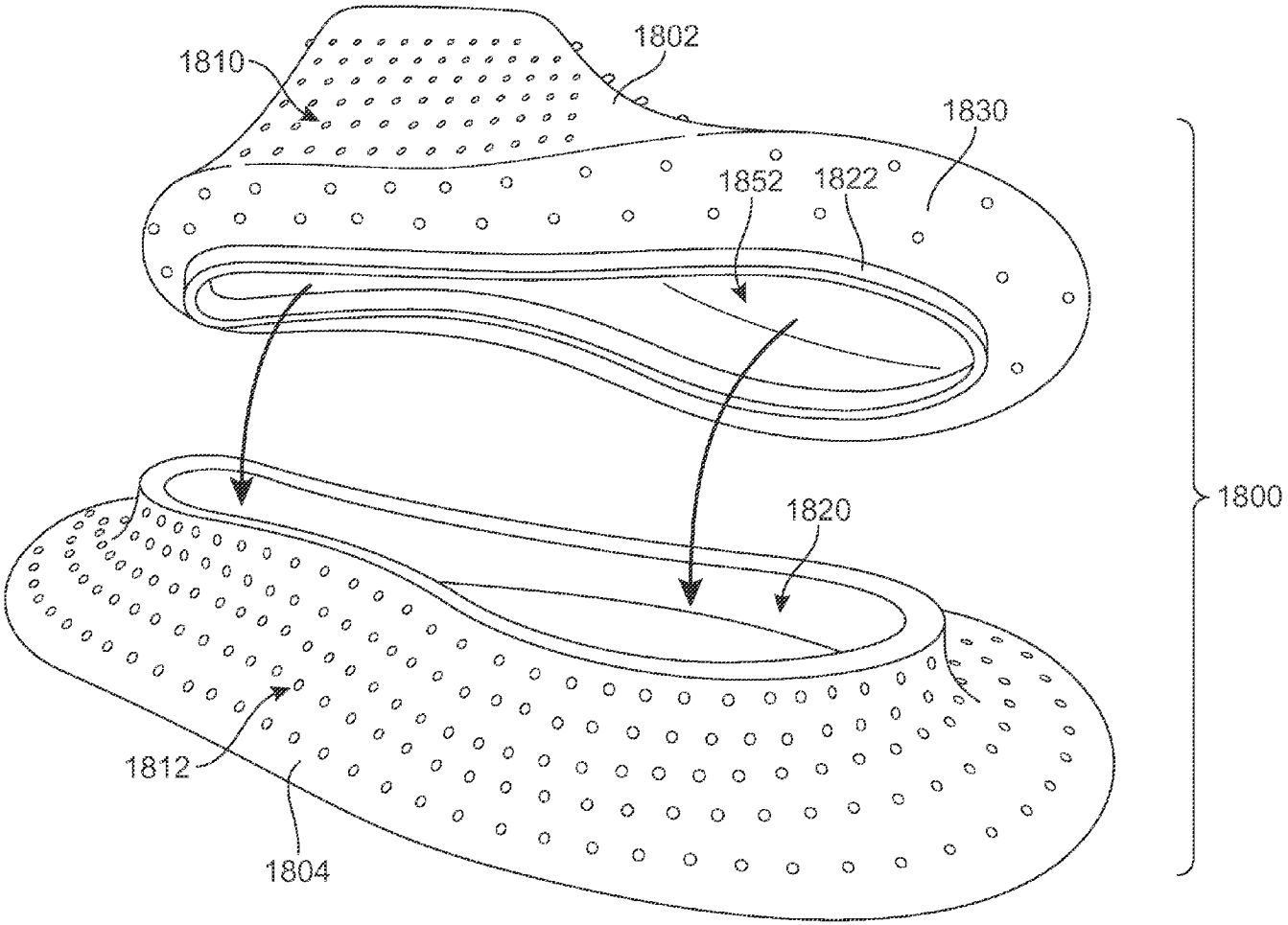
FIG. 18 is a schematic exploded isometric view of an embodiment of a last assembly.
Figure 19:
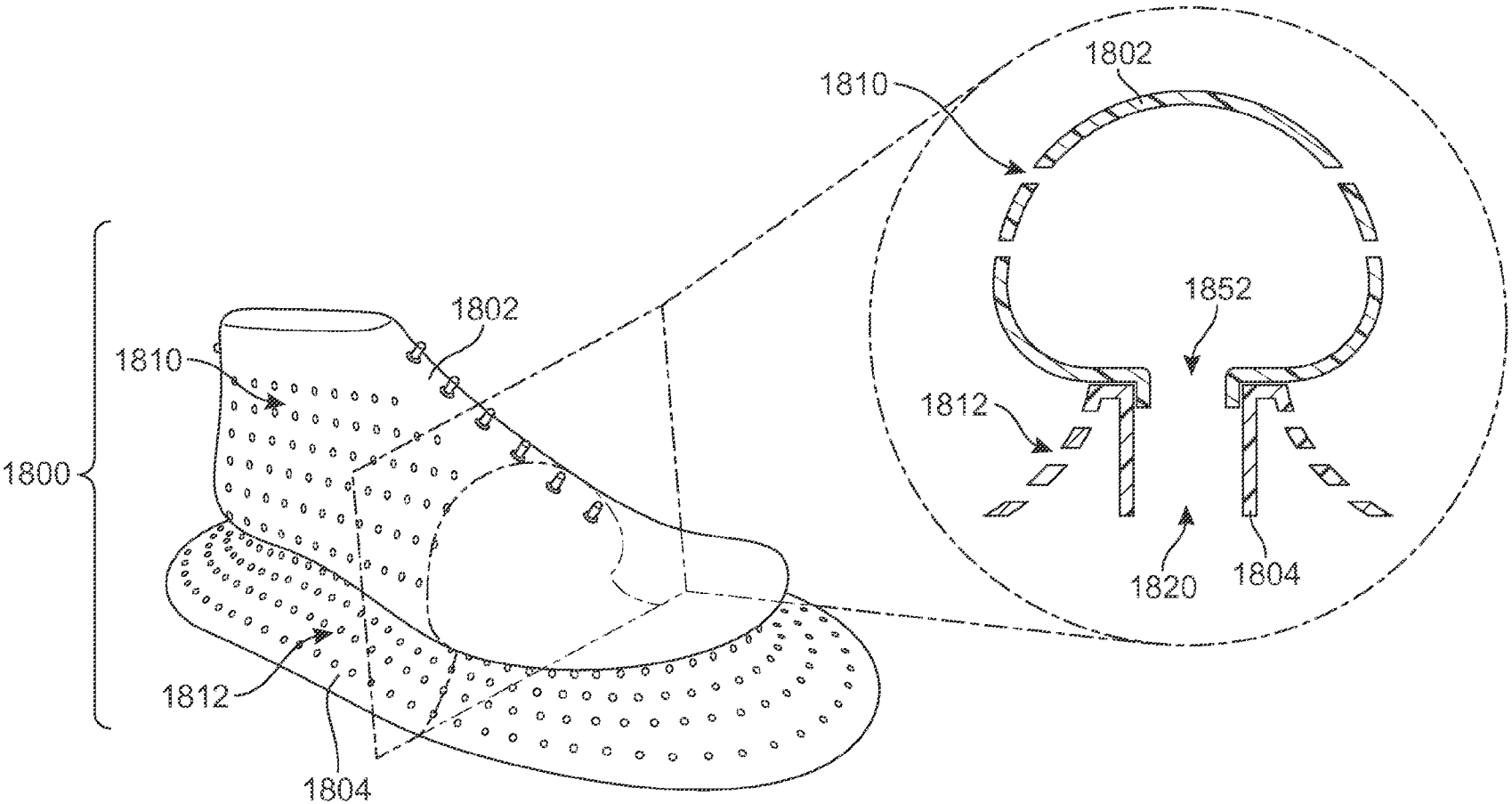
FIG. 19 is a schematic isometric view of an embodiment of a last assembly as well as an enlarged cross-sectional view of the last assembly.

FIGS. 18 and 19 illustrate an exploded isometric view and an assembled isometric view, respectively, of an embodiment of a last assembly 1800. In some embodiments, last assembly 1800 may comprise last member 1802 as well as a separable base member 1804. As in the previous embodiments, last member 1802 and base member 1804 may both include a plurality of vacuum holes, including first set of vacuum holes 1810 and second set of vacuum holes 1812, respectively. These two sets of vacuum holes may function in a similar manner to the vacuum holes described above in other embodiments.

In order to facilitate easy attachment and separation of last member 1802 with base member 1804, last assembly 1800 may be configured with corresponding fitting and/or alignment features. In one embodiment, base member 1804 may include a central slot 1820. Additionally, last member 1802 may include an extended portion 1822 that extends outwardly from a lower surface 1830 of last member 1802. As seen in the enlarged cross-sectional view of FIG. 19, extended portion 1822 may insert into central slot 1820 in order facilitate alignment of last member 1802 with base member 1804 as well as to provide a stable connection between last member 1802 and base member 1804.

In different embodiments, the geometry of central slot 1820 could vary. In some embodiments, central slot 1820 extends through the entire thickness of base portion 1804. In other embodiments, central slot 1820 may only extend partially through the thickness of base portion 1804. In such embodiments, central slot 1820 may be characterized as groove-like or recessed.

In different embodiments, the geometry of extended portion 1822 could vary. In some embodiments, extended portion 1822 has a ridge-like geometry that forms the boundary of a central opening 1852 on lower surface 1830. Extended portion 1822 may extend far enough from lower surface 1830 to insert into central slot 1820 to a desired depth. Therefore, the height of extended portion 1822 as measured from lower surface 1830 can be selected according to various factors including the desired type and degree of connection between last member 1802 and base member 1804.

Although both central slot 1820 on base member 1804 and extended portion 1822 on last member 1802 are seen as extending through a majority of the length of last assembly 1800, in other embodiments the lengths of extended portion 1822 and central slot 1820 could vary in any other manner. Furthermore, other embodiments could include multiple slots in base member 1804 that correspond with multiple extended portions in last member 1802.

The type of connection between last member 1802 and base member 1804 can vary. In some cases, for example, extended portion 1822 may be tightly fit within central slot 1820, so that extended portion 1822 and central slot 1820 provide a frictional fit between last member 1802 and base member 1804. However, in other embodiments, extended portion 1822 may be loosely fit into central slot 1820 so that last member 1802 rests on, but is not substantially connected to, base member 1804. Furthermore, in some cases, the vacuum used to draw material against the outer surfaces of last member 1802 and base member 1804 may act to temporarily keep last member 1802 attached to base member 1804.

The arrangement described above may facilitate improved manufacturing by allowing for a separable last member 1802 and base member 1804 that can be easily separated and reattached. This may provide for arrangements, for example, where base member 1804 is fixedly or temporarily attached to a vacuum table or other component, with the removable last member 1802 being easily accessible to a user. This can also facilitate situations where material from the upper must be associated with a lower surface or periphery of last member 1802 before the vacuum is applied.

While various embodiments of the embodiments have been described, the description is intended to be exemplary, rather than limiting and it will be apparent to those of ordinary skill in the art that many more embodiments and implementations are possible that are within the scope of the embodiments. Accordingly, the embodiments is not to be restricted except in light of the attached claims and their equivalents. Also, various modifications and changes may be made within the scope of the attached claims.

What is claimed is:

1. A last member having a medial side, a lateral side opposite the medial side, a forefoot portion, a heel portion opposite the forefoot portion, a midfoot portion disposed between the forefoot portion and the heel portion, and an upper instep portion extending through a top of the midfoot portion and the forefoot portion, the last member further comprising:

a plurality of retractable pins extending from an outer surface of the last member, wherein each pin of the plurality of retractable pins includes:

an exterior terminal end and an interior terminal end opposite the exterior terminal end;

an extended position and a retracted position, wherein the exterior terminal end is closer to the outer surface of the last member in the retracted position than in the extended position;

wherein the plurality of retractable pins are divided into a first set of retractable pins and a second set of retractable pins, wherein the first set of retractable pins are aligned with each other along a straight line that extends longitudinally on the upper instep portion of the last member and wherein the second set of retractable pins are aligned with each other along a straight line that extends along a rearwardly facing portion of the heel portion;

a plurality of springs, wherein each spring of the plurality of springs is disposed at the interior terminal end of one of the plurality of retractable pins in a position that is beneath the outer surface of the upper instep portion of the last member, wherein the respective spring biases the respective pin in the extended position; and a plurality of vacuum holes disposed on the outer surface.

2. The last member according to claim 1, wherein the plurality of vacuum holes are disposed on both the medial side and the lateral side in both the midfoot portion and the heel portion.

3. The last member according to claim 1, wherein the plurality of vacuum holes are spaced apart from each other in a uniform arrangement.

4. The last member according to claim 1, wherein the plurality of vacuum holes are in fluid communication with a vacuum pump.

5. The last member according to claim 1, wherein the second set of retractable pins includes a first pin and a second pin disposed closer to an ankle portion of the last member than the first pin is disposed.

6. The last member according to claim 1, wherein each pin of the plurality of retractable pins has a flange portion disposed within a respective cavity having cavity walls disposed within the last member.

7. The last member according to claim 1, wherein the plurality of vacuum holes are only disposed on the midfoot portion and the heel portion.

8. A last member having a medial side, a lateral side opposite the medial side, a forefoot portion, a heel portion opposite the forefoot portion, a midfoot portion disposed between the forefoot portion and the heel portion, and an upper instep portion extending through a top of the midfoot portion and the forefoot portion, the last member further comprising:

a plurality of retractable pins extending from an outer surface of the last member, wherein each pin of the plurality of retractable pins includes:

an exterior terminal end and an interior terminal end opposite the exterior terminal end;

an extended position and a retracted position, wherein the exterior terminal end is closer to the outer surface of the last member in the retracted position than in the extended position;

wherein the plurality of retractable pins are divided into a first set of retractable pins and a second set of retractable pins, wherein the first set of retractable pins are disposed on the upper instep portion of the last member, wherein the second set of retractable pins are disposed on a rearwardly facing portion of the heel portion, and wherein the first set of retractable pins and the second set of retractable pins are all aligned with each other along a plane that longitudinally bisects the last member; and a plurality of vacuum holes disposed on the outer surface on both the medial side and the lateral side in both the midfoot portion and the heel portion.

9. The last member according to claim 8, wherein the second set of retractable pins includes a first pin and a second pin disposed closer to an ankle portion of the last member than the first pin is disposed.

10. The last member according to claim 8, wherein the exterior terminal end of each respective pin of the plurality of retractable pins is flush with the outer surface of the last member when the respective pin is in the retracted position.

11. The last member according to claim 8, wherein the plurality of vacuum holes are spaced apart from each other in a uniform arrangement.

12. The last member according to claim 8, wherein the plurality of vacuum holes are in fluid communication with a vacuum pump.

13. The last member according to claim 8, wherein the second set of retractable pins includes a first pin and a second pin disposed closer to an ankle portion of the last member than the first pin is disposed.

14. The last member according to claim 8, wherein the plurality of vacuum holes are only disposed on the midfoot portion and the heel portion.

15. A last member having a medial side, a lateral side opposite the medial side, a forefoot portion, a heel portion opposite the forefoot portion, a midfoot portion disposed between the forefoot portion and the heel portion, and an upper instep portion extending through a top of the midfoot portion and the forefoot portion, the last member further comprising:

a plurality of retractable pins extending from an outer surface of the last member, wherein each pin of the plurality of retractable pins includes:

an exterior terminal end and an interior terminal end opposite the exterior terminal end; and an extended position and a retracted position, wherein the exterior terminal end is closer to the outer surface of the last member in the retracted position than in the extended position;

wherein the plurality of retractable pins are divided into a first set of retractable pins and a second set of retractable pins, wherein the first set of retractable pins are disposed on the upper instep portion of the last member, wherein the second set of retractable pins are disposed on a rearwardly facing portion of the heel portion, and wherein the first set of retractable pins and the second set of retractable pins are all aligned along a plane that longitudinally bisects the last member;

a plurality of springs, wherein each spring of the plurality of springs is disposed at the interior terminal end of the respective pin in a position that is beneath the outer surface of the upper instep portion of the last member, wherein the respective spring biases the respective pin in the extended position; and a plurality of vacuum holes disposed on the outer surface on both the medial side and the lateral side, wherein a forwardmost vacuum hole of the plurality of vacuum holes is disposed in the midfoot portion.

16. The last member according to claim 15, wherein the second set of retractable pins includes a first pin and a second pin disposed closer to an ankle portion of the last member than the first pin is disposed.

17. The last member according to claim 15, wherein each pin of the plurality of retractable pins has a flange portion disposed within a respective cavity having cavity walls disposed within the last member.

18. The last member according to claim 15, wherein the plurality of vacuum holes are disposed in both the midfoot portion and the heel portion.

19. The last member according to claim 15, wherein the plurality of vacuum holes are spaced apart from each other in a uniform arrangement.

20. The last member according to claim 15, wherein the plurality of vacuum holes are in fluid communication with a vacuum pump.

* * * * *